US009403388B2

(12) United States Patent
Ozaki

(10) Patent No.: US 9,403,388 B2
(45) Date of Patent: Aug. 2, 2016

(54) RECORDING MEDIUM TRANSPORTING DEVICE AND INKJET RECORDING DEVICE

(71) Applicant: FUJIFILM Corporation, Tokyo (JP)

(72) Inventor: Takao Ozaki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/844,428

(22) Filed: Sep. 3, 2015

(65) Prior Publication Data

US 2015/0375541 A1 Dec. 31, 2015

Related U.S. Application Data

(63) Continuation of application No. PCT/JP2014/054646, filed on Feb. 26, 2014.

(30) Foreign Application Priority Data

Mar. 6, 2013 (JP) ..... 2013-044311

(51) Int. Cl.
*B41J 15/04* (2006.01)
*B65H 5/12* (2006.01)
*B41J 13/22* (2006.01)

(52) U.S. Cl.
CPC ..... *B41J 15/04* (2013.01); *B41J 13/223* (2013.01); *B65H 5/12* (2013.01)

(58) Field of Classification Search
CPC .. B41J 11/0065; B41J 11/007; B41J 11/0085; B41J 11/06; B41J 13/103
USPC ..... 347/104; 101/216, 217; 271/3.14
See application file for complete search history.

(56) References Cited

U.S. PATENT DOCUMENTS 6,314,881 B1 11/2001 Gotting
2011/0234664 A1* 9/2011 Sumi ..... B41J 11/42 347/9

(Continued)

FOREIGN PATENT DOCUMENTS

JP H01-133074 A 5/1989
JP H09-066597 A 3/1997

(Continued)

OTHER PUBLICATIONS

International Preliminary Report on Patentability for PCT/JP2014/054646 dated Nov. 12, 2014.

(Continued)

*Primary Examiner* — Manish S Shah
*Assistant Examiner* — Roger W Pisha, II
(74) *Attorney, Agent, or Firm* — Studebaker & Brackett PC

(57) ABSTRACT

In a recording medium transporting device, an inter-shaft distance between a printing barrel that rotates and transports with gripping an end portion of a recording medium inwardly from an outer peripheral surface thereof and a first transporting barrel juncturally connected with the printing barrel is set to be a distance shorter than a sum of a radius of the printing barrel and a radius of the first transporting barrel, and an inter-shaft distance between the first transporting barrel and a second transporting barrel juncturally connected with the first transporting barrel is set to be a sum of the radius of the first transporting barrel and a radius of the second transporting barrel, which can suppress distortion of the recording medium and enables the first transporting barrel and the second transporting barrel to grip the end portion of the recording medium on the outer peripheral surface thereof, allowing stable transportation.

18 Claims, 18 Drawing Sheets

(56) References Cited

U.S. PATENT DOCUMENTS

| | | | | |
|---|---|---|---|---|
| 2011/0234730 | A1* | 9/2011 | Fukui | B41J 13/223 347/104 |
| 2012/0188318 | A1* | 7/2012 | Yamanobe | B41J 11/002 347/102 |
| 2013/0091970 | A1 | 4/2013 | O-Oka et al. | |

FOREIGN PATENT DOCUMENTS

| | | | |
|---|---|---|---|
| JP | 2000-033686 | A | 2/2000 |
| JP | 2000-318139 | A | 11/2000 |
| JP | 2011-173279 | A | 9/2011 |
| WO | 2011/161742 | A1 | 12/2011 |

OTHER PUBLICATIONS

Written Opinion for PCT/JP2014/054646 dated May 27, 2014.
International Search Report for PCT/2014/054646 dated May 27, 2014.
Translation of International Preliminary Report on Patentability (Chapter II); PCT/JP2014/054646.

* cited by examiner

RECORDING MEDIUM TRANSPORTING DEVICE AND INKJET RECORDING DEVICE

CROSS-REFERENCE TO RELATED APPLICATIONS

This application is a Continuation of PCT International Application No. PCT/JP2014/054646 filed on Feb. 26, 2014, which claims priority under 35 U.S.C §119(a) to Japanese Patent Application No. 2013-044311 filed on Mar. 6, 2013. Each of the above applications is hereby expressly incorporated by reference, in their entirety, into the present application.

BACKGROUND OF THE INVENTION

1. Field of the Invention

The present invention relates to a recording medium transporting device and an inkjet recording device, and particularly to a multistage drum type (tandem type) recording medium transporting device and inkjet recording device.

2. Description of the Related Art

In an inkjet printing device, a distance between an inkjet head and a surface to be printed (through distance) is set to be small as much as possible in order to stably maintain a jetted ink landing position. In general, the distance between the inkjet head and the surface to be printed is often set to be about several millimeters or less, or 1 mm or less if possible.

On the other hand, in a printing machine, a multistage drum type (tandem type) sheet-of-paper transporting technology has been established in which a sheet of paper is transported with a leading end thereof being held by a grasping claw and passed from a drum to a drum. In the sheet-of-paper transporting technology used for the printing machine, a surface of the grasping claw supporting the paper sheet is configured to be protruded from a surface of the drum.

In order to achieve inkjet printing by use of this sheet-of-paper transporting device, a protruding amount of the grasping claw of a drum having the inkjet head mounted thereon (hereinafter, referred to as a printing drum) needs to be small.

Japanese Patent Application Laid-Open No. 2011-173279 (PTL 1), dealing with such a problem, describes a technology in which a grasping claw is arranged to be housed in a recessed part so as not to be protruded from a peripheral surface of the printing drum.

SUMMARY OF THE INVENTION

The multistage drum type sheet-of-paper transporting device has a configuration in which, in passing the paper sheet from an upstream drum to a downstream drum, the leading end portions of the paper sheet are simultaneously held by a grasping unit of the upstream drum and a grasping unit of the downstream drum. In the PTL 1, a grasping unit of a drum of a stage prior to the printing drum is arranged on an outer peripheral surface, and a grasping unit of the printing drum is arranged on an inner side on the drum. Therefore, in passing the paper sheet between these two drums, the paper sheet may be sometimes passed with the leading end portion thereof being in a wavy state caused by the grasping unit s of both drums. This may leave deformation or creases on the paper sheet.

The present invention has been made in consideration of such a circumstance, and has an object to provide a recording medium transporting device and inkjet recording device capable of suppressing distortion of a recording medium caused by a grasping unit and stably transporting the recording medium.

In order to achieve the above object, an aspect of a recording medium transporting device includes a printing barrel that rotates and transports with gripping an end portion of a recording medium inwardly from an outer peripheral surface thereof, an inkjet head for ejecting and depositing ink onto the recording medium being arranged on the outer peripheral surface so as to face the printing barrel, and a first transporting barrel that rotates and transports with gripping the end portion of the recording medium on an outer peripheral surface thereof for passing to the printing barrel and a second transporting barrel that rotates and transports with gripping the end portion of the recording medium on an outer peripheral surface thereof for passing to the first transporting barrel, or a first transporting barrel that rotates and transports with gripping the end portion of the recording medium received from the printing barrel and a second transporting barrel that rotates and transports with gripping the end portion of the recording medium received from the first transporting barrel on an outer peripheral surface thereof, wherein an inter-shaft distance between the printing barrel and the first transporting barrel is set to be a distance shorter than a sum of a radius of the printing barrel and a radius of the first transporting barrel, and an inter-shaft distance between the first transporting barrel and the second transporting barrel is set to be a sum of the radius of the first transporting barrel and a radius of the second transporting barrel.

According to this aspect, the inter-shaft distance between the printing barrel that rotates and transports with gripping the end portion of the recording medium inwardly from the outer peripheral surface thereof and the first transporting barrel juncturally connected with the printing barrel is set to be the distance shorter than the sum of the radius of the printing barrel and the radius of the first transporting barrel, and the inter-shaft distance between the first transporting barrel and the second transporting barrel juncturally connected with the first transporting barrel is set to be the sum of the radius of the first transporting barrel and the radius of the second transporting barrel, which can suppress distortion of the recording medium, and enables the first transporting barrel and the second transporting barrel to grip the end portion of the recording medium on the outer peripheral surface thereof, allowing stable transportation.

It is preferable that the printing barrel grips the end portion of the recording medium inwardly by a distance d from the outer peripheral surface, and the inter-shaft distance between the printing barrel and the first transporting barrel is set to be a distance shorter by a distance d than the sum of the radius of the printing barrel and the radius of the first transporting barrel. This allows the distortion of the recording medium to be suppressed.

It is preferable that each of the printing barrel, the first transporting barrel, and the second transporting barrel has a gear coupled to a rotation shaft thereof, and the gear of the printing barrel and the gear of the first transporting barrel directly engage with each other, and the gears of the first transporting barrel and the second transporting barrel directly engage with each other, and the inter-shaft distance is set by shifting the gear of the printing barrel. This allows the inter-shaft distance to be appropriately set.

It is preferable to include a motor for driving the gear of the printing barrel, the gear of the first transporting barrel and the gear of the second transporting barrel. This allows the recording medium to be appropriately transported.

It is preferable that diameters of the printing barrel, the first transporting barrel, and the second transporting barrel have an integral multiple relationship with each other. In addition, the respective barrels may have the same diameter. This allows the recording medium to be appropriately passed.

It is preferable that the printing barrel and the first transporting barrel have plural grasping units for gripping by grasping the end portion of the recording medium along rotation shaft directions respectively, and the plural grasping units of the printing barrel and the plural grasping units of the first transporting barrel are alternately arranged along the rotation shaft directions respectively. This allows the recording medium to be appropriately gripped.

It is preferable that when the recording medium is passed from the first transporting barrel to the printing barrel or from the printing barrel to the first transporting barrel, the plural grasping units of the first transporting barrel and the plural grasping units of the printing barrel simultaneously grasp the end portion of the recording medium. This allows the recording medium to be appropriately passed. In addition, the plural grasping units of the printing barrel may be arranged on the outer peripheral surface at two locations that are symmetric positions about the rotation shaft of the printing barrel.

It is preferable that the end portion of the recording medium is a leading end portion. This allows the recording medium to be appropriately gripped to be transported.

In order to achieve the above object, an aspect of an inkjet recording device includes recording medium transporting device including a printing barrel that rotates and transports with gripping an end portion of a recording medium inwardly from an outer peripheral surface thereof, an inkjet head for ejecting and depositing ink onto the recording medium being arranged on the outer peripheral surface so as to face the printing barrel, and a first transporting barrel that rotates and transports with gripping the end portion of the recording medium on an outer peripheral surface thereof for passing to the printing barrel and a second transporting barrel that rotates and transports with gripping the end portion of the recording medium on an outer peripheral surface thereof for passing to the first transporting barrel, or a first transporting barrel that rotates and transports with gripping the end portion of the recording medium received from the printing barrel on the outer peripheral surface thereof and a second transporting barrel that rotates and transports with gripping the end portion of the recording medium received from the first transporting barrel on an outer peripheral surface thereof, wherein an inter-shaft distance between the printing barrel and the first transporting barrel is set to be a distance shorter than a sum of a radius of the printing barrel and a radius of the first transporting barrel, and an inter-shaft distance between the first transporting barrel and the second transporting barrel is set to be a sum of the radius of the first transporting barrel and a radius of second transporting barrel, and an inkjet head arranged so as to face the outer peripheral surface of the printing barrel.

According to this aspect, high-definition inkjet printing by the inkjet head arranged facing the printing barrel is enabled. Moreover, distortion of the recording medium can be suppressed to be small and a degree of contact of the paper sheet with the printing barrel can be increased, which enables the high-definition inkjet printing. Further, the inter-shaft distance between the printing barrel and the first transporting barrel is set to be a distance shorter than a sum of the radius of the printing barrel and the radius of the first transporting barrel, which enables the first transporting barrel and the second transporting barrel to grip the end portion of the recording medium on the outer peripheral surface thereof, allowing the stable transportation.

According to the present invention, the distortion of the recording medium can be suppressed, and the recording medium can be stably transported.

DETAILED DESCRIPTION OF EXEMPLARY EMBODIMENTS

Hereinafter, a description is given of preferred embodiments of the present invention with reference to the drawings.

<Outline of Paper Sheet Transporting Device>

Figure 1:
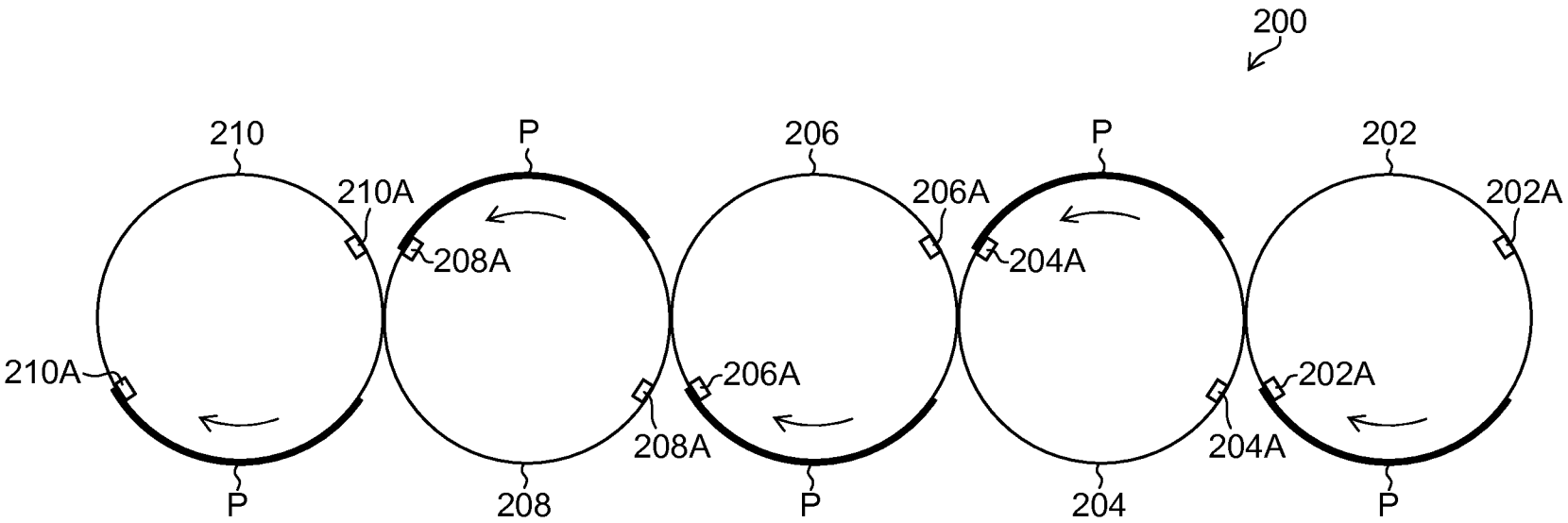
FIG. 1 is a lateral view illustrating a paper sheet transporting device.

FIG. 1 is a lateral view illustrating a paper sheet transporting device. A paper sheet transporting device 200, which is a device for transporting a paper sheet P fed from a paper feed unit (not illustrated) to a paper discharge unit (not illustrated), includes transporting barrels 202, 204, 206, 208, and 210 each of which rotates with gripping a leading end of the paper sheet P passed from an upstream side and transports the paper sheet P in a state of being held on an outer peripheral surface to pass to a downstream side.

The transporting barrel 202 receives the paper sheet P from the paper feed unit (not illustrated) and transports the paper sheet P to the transporting barrel 204. The transporting barrel 202 includes a frame member assembled in a cylindrical shape and has a gripper 202A on the outer peripheral surface thereof. The transporting barrel 202 rotates with gripping by the gripper 202A the leading end of the paper sheet P to transport the paper sheet P to the transporting barrel 204. Note that the transporting barrel 202 has the gripper 202A arranged on the outer peripheral surface thereof at each of two locations (symmetric positions about a rotation shaft) to be configured such that two paper sheets P can be transported per one rotation. The transporting barrel 202 and the transporting barrel 204 are driven such that their timings of receiving and passing the paper sheet P coincide with each other and such that positions of their grippers match each other.

The transporting barrel 204 receives the paper sheet P from the transporting barrel 202 to transport the paper sheet P to the transporting barrel 206. The transporting barrel 204 is formed into a cylindrical shape and has a gripper 204A on the outer peripheral surface thereof. The transporting barrel 204 rotates with gripping by the gripper 204A the leading end of the paper sheet P to wind the paper sheet P on the peripheral surface while transporting the paper sheet P to the transporting barrel 206. The transporting barrel 204 has a plenty of sucking holes (not illustrated) formed on the peripheral surface thereof in a predetermined pattern. The paper sheet P wound on the peripheral surface of the transporting barrel 204 is sucked from the sucking holes to be held by suction on the peripheral surface of the transporting barrel 204 while being transported. This allows the paper sheet P to be transported with flatness being highly kept.

The transporting barrel 206 is configured similar to the transporting barrel 202. The transporting barrel 206 includes a frame member assembled in a cylindrical shape and has a gripper 206A on the outer peripheral surface thereof. The transporting barrel 206 grips by the gripper 206A the leading end of the paper sheet P received from the transporting barrel 204 and rotates to transport the paper sheet P to the transporting barrel 208.

The transporting barrel 208 is configured similar to the transporting barrel 204. In other words, the transporting barrel 208 is formed into a cylindrical shape and has a gripper 208A on the outer peripheral surface thereof. The transporting barrel 208 grips by the gripper 208A the leading end of the paper sheet P received from the transporting barrel 206 and rotates to transport the paper sheet P to the transporting barrel 210.

The transporting barrel 210 is also configured similar to the transporting barrel 202. The transporting barrels 202, 204, 206, 208, and 210 are each configured to have the same diameter (diameter of a rotation trajectory of the gripper).

Figure 2:
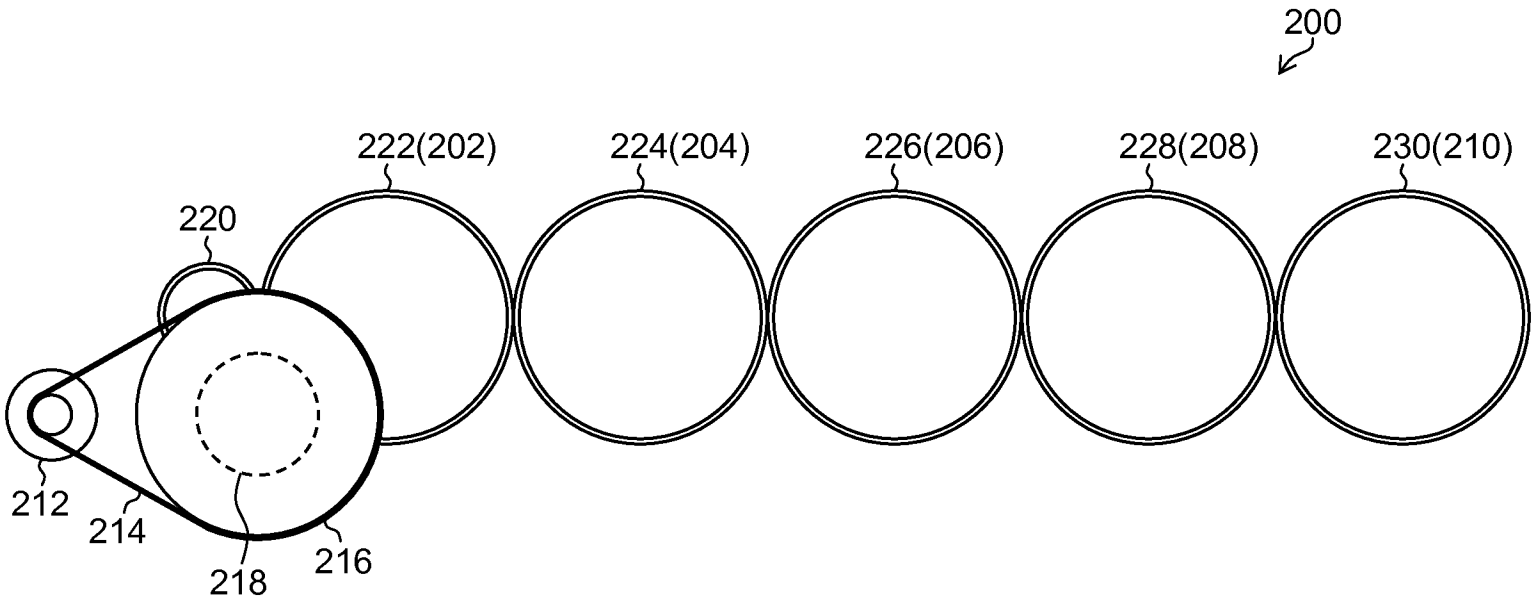
FIG. 2 is a configuration diagram of a rotary drive mechanism of the paper sheet transporting device.

FIG. 2 is a configuration diagram of a rotary drive mechanism provided on a lateral side opposite to that illustrated in FIG. 1. As illustrated in the figure, the paper sheet transporting device 200 has a motor 212 (hereinafter, referred to as "motor for rotation") provided as a motive power source for a paper sheet transporting system. Motive power from the motor 212 for rotation is transmitted via a timing belt (toothed belt having no ends) 214 to a pulley 216.

The pulley 216 is integrally coupled in a concentric manner with a toothed wheel 218, and thus, the pulley 216 and the toothed wheel 218 rotate together. The toothed wheel 218 engages with a toothed wheel 220 which is provided at the upper left of the toothed wheel 218 in FIG. 2, and the toothed wheel 220 engages with a toothed wheel (gear) 222 directly coupled to an end portion of the transporting barrel 202.

The toothed wheel 222 of the transporting barrel 202 engages with a toothed wheel 224 provided at an end portion of the transporting barrel 204, and the toothed wheel 224 engages with a toothed wheel 226 provided at an end portion of the transporting barrel 206. Subsequently, the toothed wheel 226 engages with a toothed wheel 228 of the transporting barrel 208, and the toothed wheel 228 engages with a toothed wheel 230 of the transporting barrel 210.

The respective toothed wheels 222 to 230, each of which is a toothed wheel for rotation of the transporting barrel and between which inter-shaft distances are identical, are configured to be interlocked with one another. The motive power from the motor 212 for rotation is transmitted via the timing belt 214, the pulley 216, and the toothed wheels 218 and 220 to the respective toothed wheels 222 to 230, and these toothed wheels 222 to 230 work in conjunction with one another to rotate all of the transporting barrels 202, 204, 206, 208, and 210. In the case of this example, a diameter of each of the transporting barrels 202, 204, 206, 208, and 210 matches a diameter of each of the toothed wheels 222 to 230 (pitch circle diameter), and thus, when the toothed wheel 222 rotates one revolution, the transporting barrels 204, 206, 208, and 210 also rotate one revolution.

Figure 3:
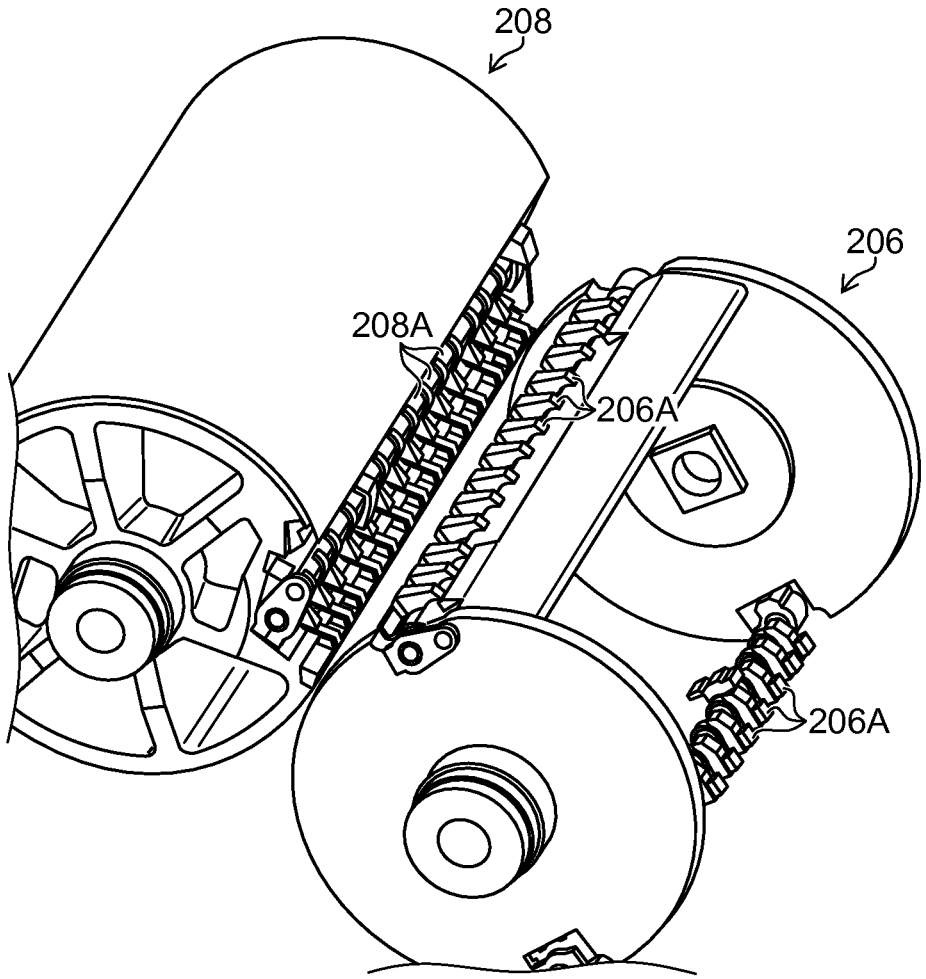
FIG. 3 is a perspective view of a transporting barrel.
Figure 4:
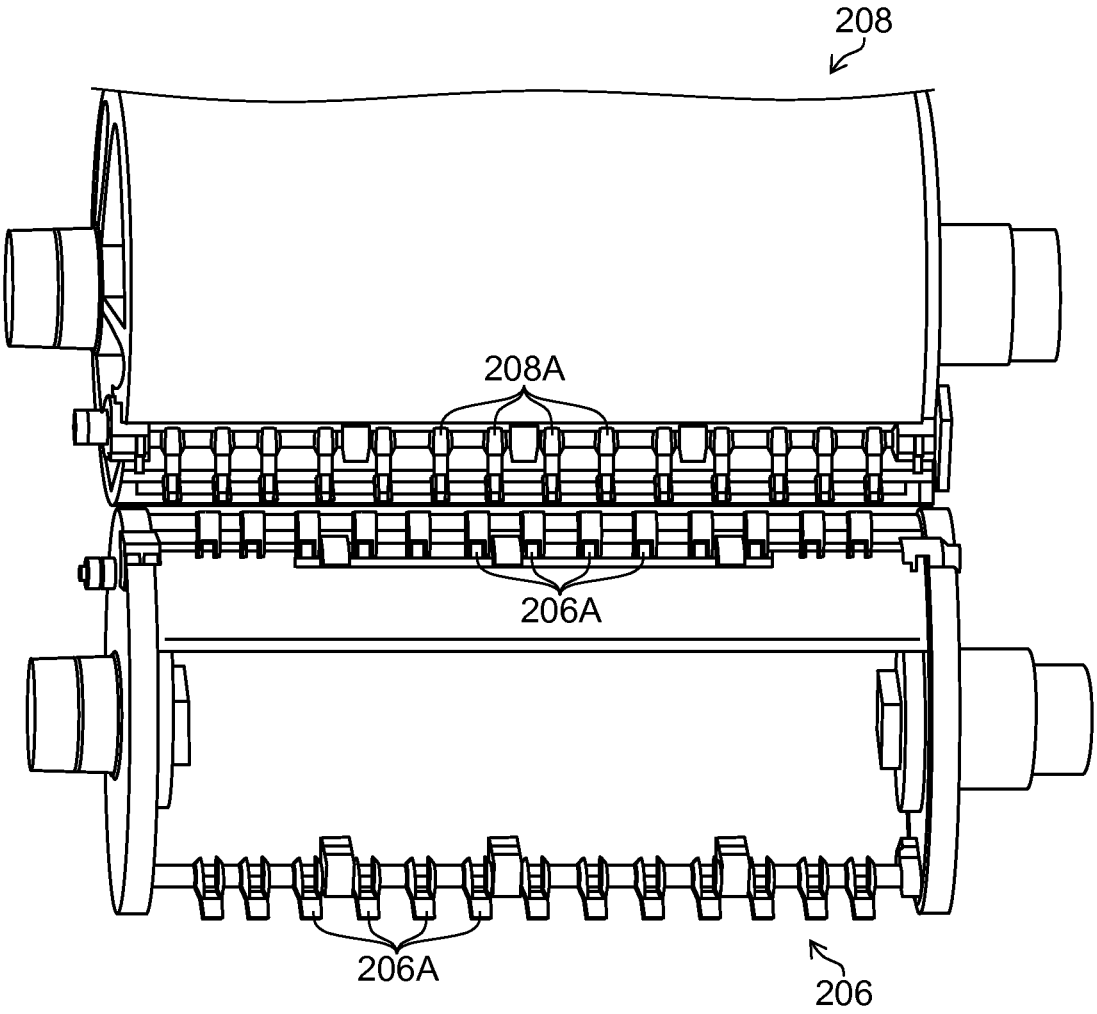
FIG. 4 is an overview illustration of the transporting barrel.

FIG. 3 and FIG. 4 are each an enlarged view illustrating the transporting barrel 206 and the transporting barrel 208, and FIG. 3 is a perspective view and FIG. 4 is an overview illustration. As illustrated in FIG. 3 and FIG. 4, the gripper 206A of the transporting barrel 206 has a claw like shape, and is provided in plural number across a length corresponding to a maximum width of the paper sheet P at certain intervals in a rotation shaft direction of the transporting barrel 206 (a direction perpendicular to a transporting direction of the paper sheet P). Similarly, the gripper 208A of the transporting barrel 208 has a claw like shape, and is provided in plural number across the length corresponding to the maximum width of the paper sheet P at certain intervals in a rotation shaft direction of the transporting barrel 208.

These plural grippers 206A and plural grippers 208A are arranged alternately in a direction perpendicular to the transporting direction of the paper sheet P. This allows the paper sheet P to be received and passed between the grippers 206A and 208A without interference therebetween.

Here, the transporting barrel 206 and the transporting barrel 208 are described, but the grippers of other transporting barrels are similarly arranged.

Figure 5A:
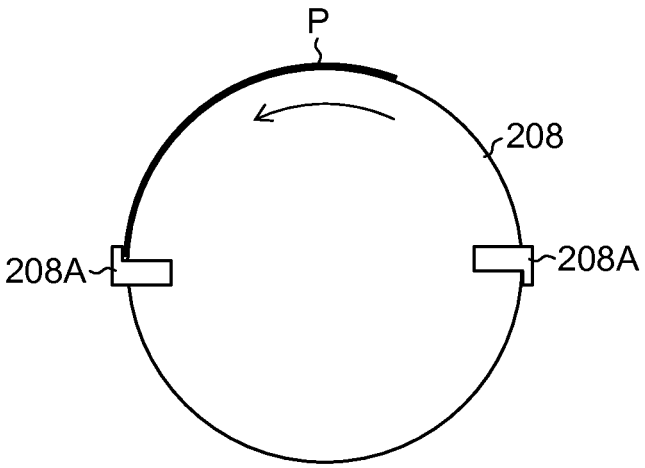
FIGS. 5A and 5B are schematic views of the transporting barrel and a gripper.
Figure 5B:
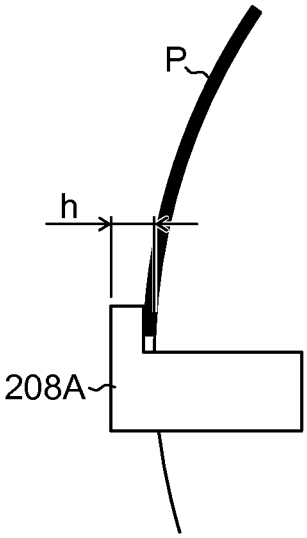

In FIG. 5A, a schematic view is illustrated of the transporting barrel 208 and the gripper 208A, and in FIG. 5B, an enlarged view is illustrated of a portion of the gripper 208A. As illustrated in the figures, the leading end of the paper sheet P is pinched between the gripper 208A and the outer peripheral surface of the transporting barrel 208. Therefore, a surface of the gripper 208A is protruded from the outer peripheral surface of the transporting barrel 208 by a thickness h of a pinching portion. The gripper 204A is configured to be similar to the gripper 208A. Further, the grippers 202A, 206A, and 210A are oriented inversely to an orientation of the gripper 208A because rotational directions of the transporting barrels 202, 206, and 210 are different from that of the transporting barrel 208, but other configurations thereof are similar to those of the gripper 208A. Therefore, each of the grippers 202A, 204A, 206A, and 210A has a configuration similar to the gripper 208A in which a surface thereof is protruded from the outer peripheral surface of each of the transporting barrels 202, 204, 206, and 210, respectively.

However, in a case where an ink is deposited from an inkjet head on the paper sheet P being transported by the transporting barrel 208 for recording an image, a distance TD (Through Distance) between a record surface of the paper sheet P and a nozzle face of the inkjet head is controversial. In other words, the TD is required to be set to be small as much as possible in order to stabilize an ink landing position, but the inkjet head and the gripper may problematically collide against each other.

<Problem Point 1 of Paper Sheet Transporting Device (Generation of Waving of Paper Sheet)>

Figure 6A:
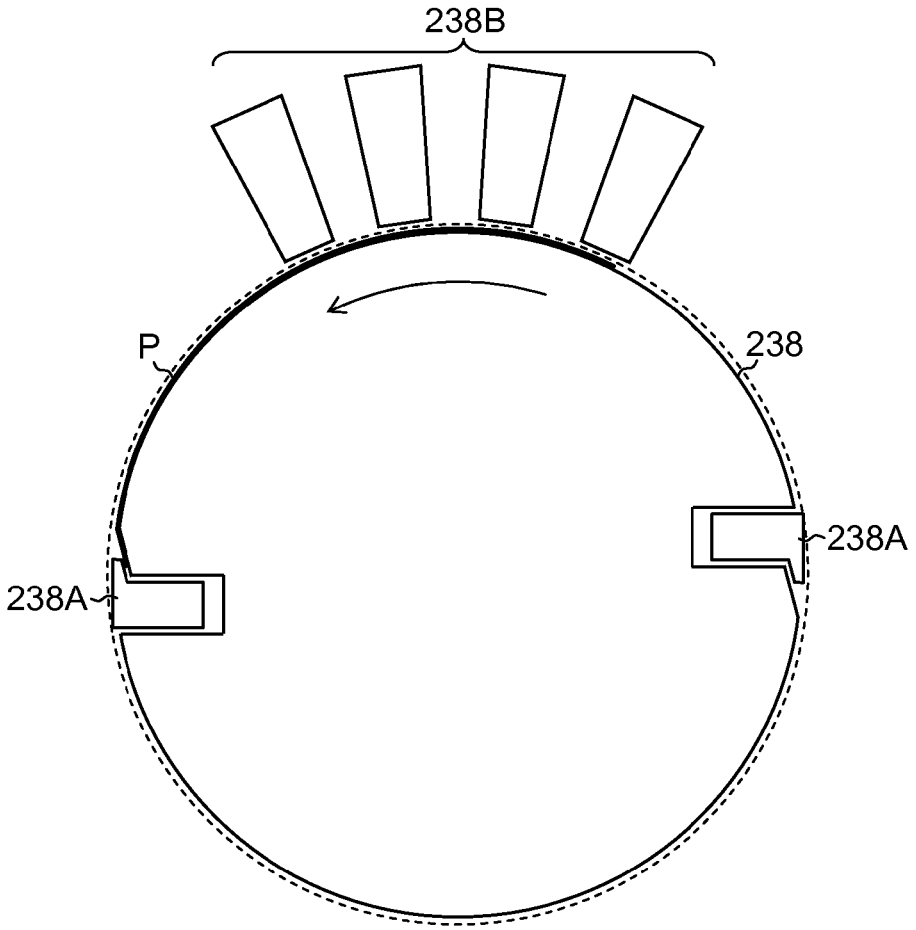
FIGS. 6A and 6B are schematic views of the transporting barrel and the gripper.
Figure 6B:
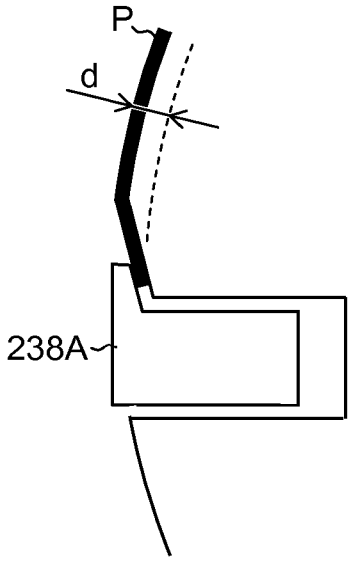

As a measure for this problem, a configuration is required in which the leading end portion of the paper sheet P is sunk down inwardly from the outer peripheral surface of the transporting barrel 208. In of FIG. 6A, a schematic view is illustrated of a transporting barrel 238 and a gripper 238A configured in this way, and in FIG. 6B, an enlarged view is illustrated of a portion of the gripper 238A. Reference sign 238B designates the inkjet head in the figure. The transporting barrel 238 has a configuration in which the leading end portion of the paper sheet P is sunk down inwardly by d from the outer peripheral surface, and the leading end of the paper sheet P is pinched between the gripper 238A and transporting barrel 238 at a position sunk down inwardly like this. Therefore, a protruding amount of the gripper 238A from the outer peripheral surface of the transporting barrel 238 is smaller by d than that of the example illustrated in FIG. 5. This allows the distance TD between the record surface of the paper sheet P and the inkjet head 238B to be set to be small.

Figure 7:
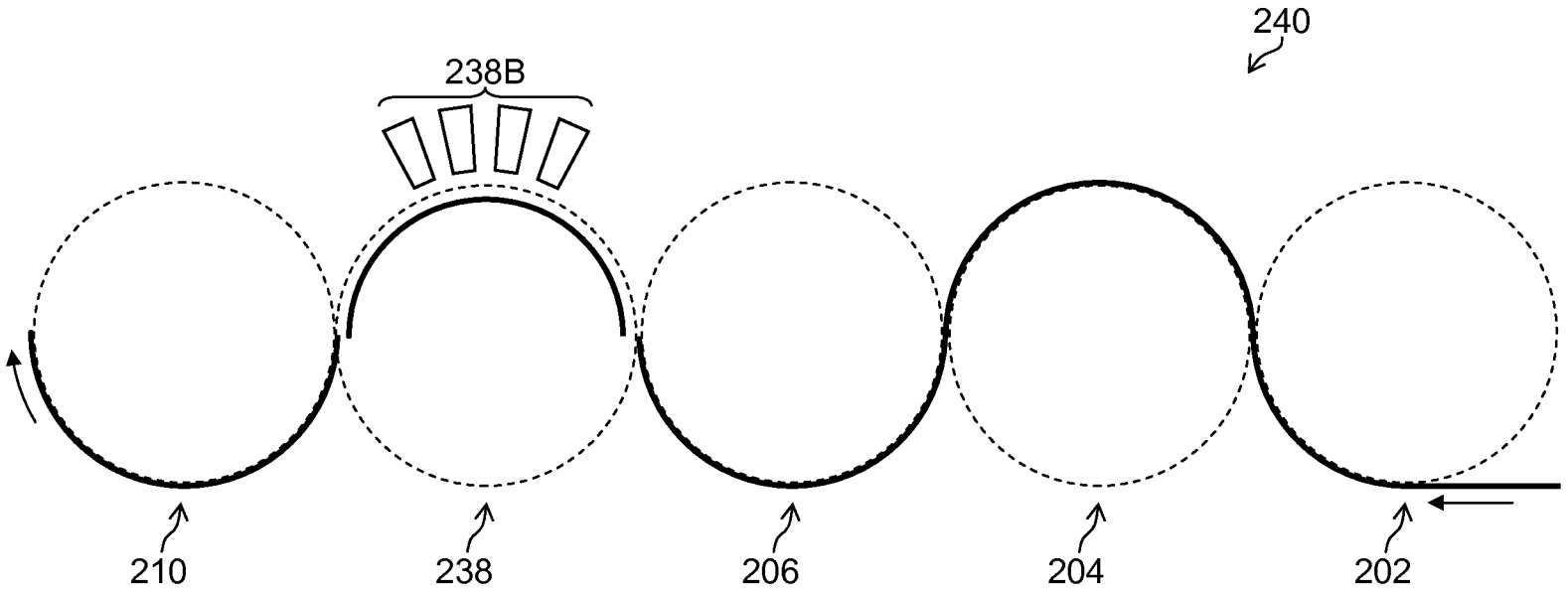
FIG. 7 is a diagram illustrating transportation of a paper sheet in the paper sheet transporting device.

FIG. 7 is a diagram illustrating transportation of the paper sheet P in a paper sheet transporting device 240 using the transporting barrel 238. The paper sheet transporting device 240 includes the transporting barrels 202, 204, 206, 238, and 210, and the transporting barrel 238 illustrated in FIG. 6 is used in place of the transporting barrel 208 of the paper sheet transporting device 200 illustrated in FIG. 1. Reference sign 238B designates the inkjet head in the figure.

In FIG. 7, a solid line represents of a trajectory of the leading end portion of the paper sheet P, and a chain line represents a drive pitch circle of the toothed wheel of each transporting barrel. Similarly to paper sheet transporting device 200, the inter-shaft distances are all set to be identical between the toothed wheels.

The trajectory of the leading end portion of the paper sheet P is continuous from the transporting barrel 202 to the transporting barrel 204 and from the transporting barrel 204 to the transporting barrel 206. Therefore, the passing of the paper sheet P via the grippers is carried out with no paper sheet deformation being generated.

In contrast, from the transporting barrel 206 to the transporting barrel 238, the gripper 206A of the transporting barrel 206 grips the paper sheet P on the outer peripheral surface of the transporting barrel 206, whereas the gripper 238A of the transporting barrel 238 grips the paper sheet P on an inner side of the outer peripheral surface of the transporting barrel 238, which causes the trajectory of the leading end portion of the paper sheet P to be discontinuous.

Similarly, also in passing from the transporting barrel 238 to the transporting barrel 210, the trajectory of the leading end portion of the paper sheet P is discontinuous.

Figure 8A:
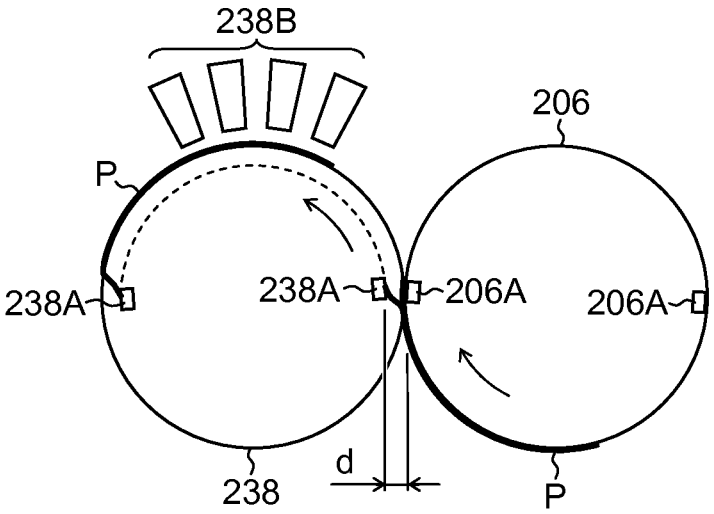
FIGS. 8A and 8B are diagrams explaining waving of the paper sheet.
Figure 8B:
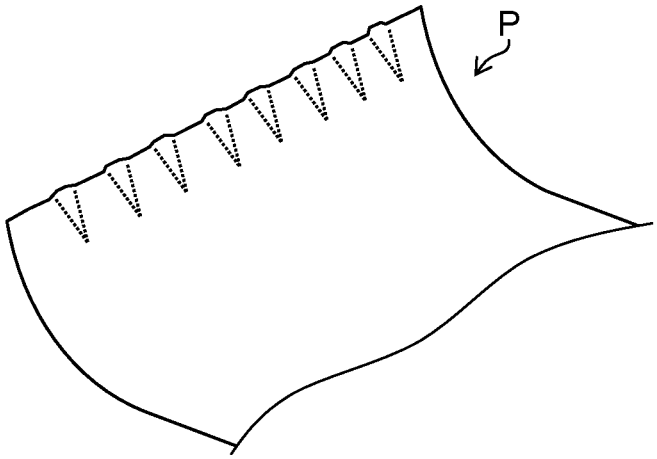

Specifically, as illustrated in FIG. 8A, at a position where the paper sheet P is passed from the transporting barrel 206 to the transporting barrel 238, a row of the plural grippers 206A and a row of the plural grippers 238A are apart from each other by the distance d, and do not align on the same line. Therefore, if the respective grippers grasp the leading end of the paper sheet P, waving is generated at the leading end portion of the paper sheet P as illustrated in FIG. 8B. In passing the paper sheet P from the transporting barrel 238 to the transporting barrel 210 also, waving is generated similarly. This waving is notably generated particularly when a thickness of the paper sheet P is large.

<Problem Point 2 of Paper Sheet Transporting Device (Positional Accuracy Degradation of Paper Sheet Transporting)>

Figure 9A:
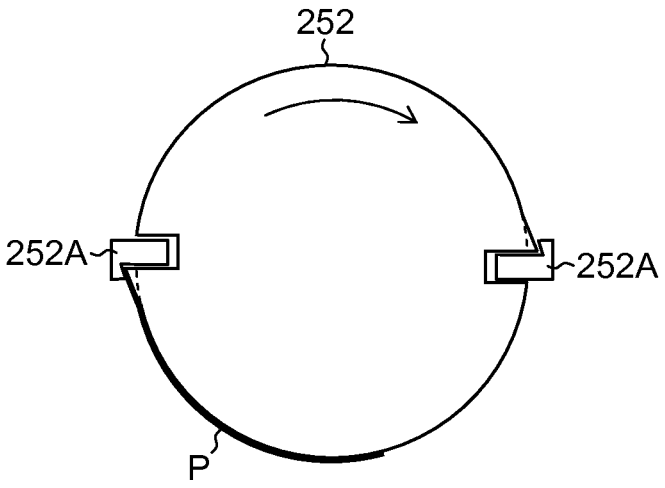
FIGS. 9A and 9B are schematic views of the transporting barrel and the gripper.
Figure 9B:
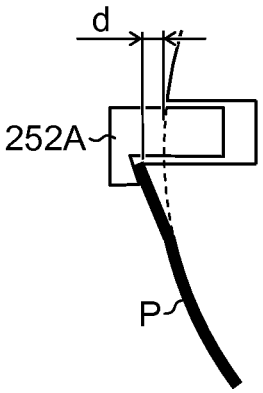

In order to prevent this waving of the paper sheet P, it may be considered that a transporting barrel, in place of the transporting barrel 206, is used in which the leading end portion of the paper sheet P is griped on an outer side by d from the outer peripheral surface. In FIG. 9A, a schematic view is illustrated of a transporting barrel 252 and a gripper 252A configured in this way and in FIG. 9B, an enlarged view is illustrated of a portion of the gripper 252A. The transporting barrel 252 has a configuration in which the leading end portion of the paper sheet P is protruded outwardly by d from the outer peripheral surface, and the leading end of the paper sheet P is pinched between the gripper 252A and the transporting barrel 252 at a position protruded outwardly like this.

Figure 10:
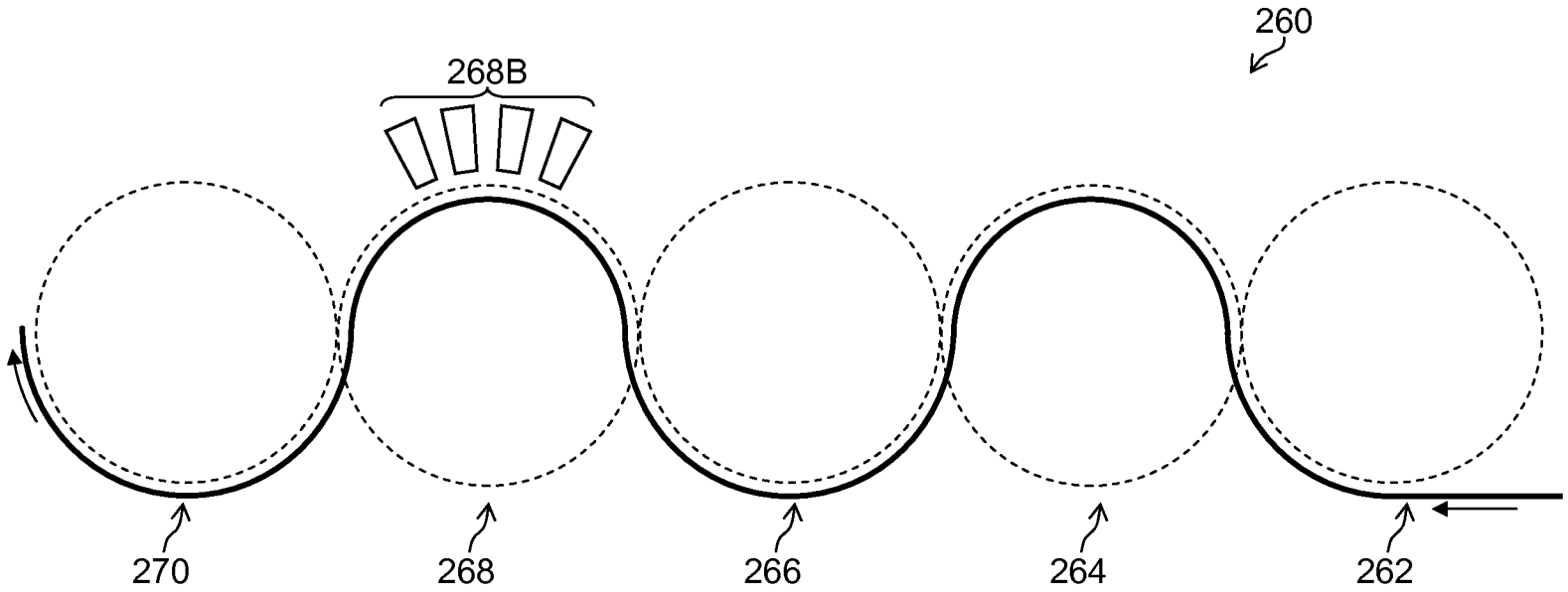
FIG. 10 is a diagram illustrating transportation of the paper sheet in the paper sheet transporting device.

FIG. 10 is a diagram illustrating transportation of the paper sheet P in a paper sheet transporting device 260 using the transporting barrel 238 and the transporting barrel 252. The paper sheet transporting device 260 includes transporting barrels 262, 264, 266, 268, and 270 each having the same diameter, and the transporting barrel 238 illustrated in FIG. 6 is applied to the transporting barrels 264 and 268 and the transporting barrel 252 illustrated in FIG. 9 is applied to the transporting barrels 262, 266, and 270. Here, grippers of the transporting barrels 262, 264, 266, 268, and 270 are designated by reference signs 262A, 264A, 266A, 268A, and 270A, respectively.

A rotary drive mechanism of the paper sheet transporting device 260 is similar to that of the paper sheet transporting device 200 illustrated in FIG. 2, and the inter-shaft distances are all set to be identical between the toothed wheels. Reference sign 268B designates the inkjet head in the figure.

In FIG. 10, a solid line represents a trajectory of the leading end portion of the paper sheet P, and a chain line represents a drive pitch circle of toothed wheel of each transporting barrel. As illustrated in the figure, the trajectory of the leading end portion of the paper sheet P is continuous in the respective transporting barrels 262 to 270, and the passing of the paper sheet P via the grippers is carried out with no paper sheet deformation being generated.

Figure 11A:
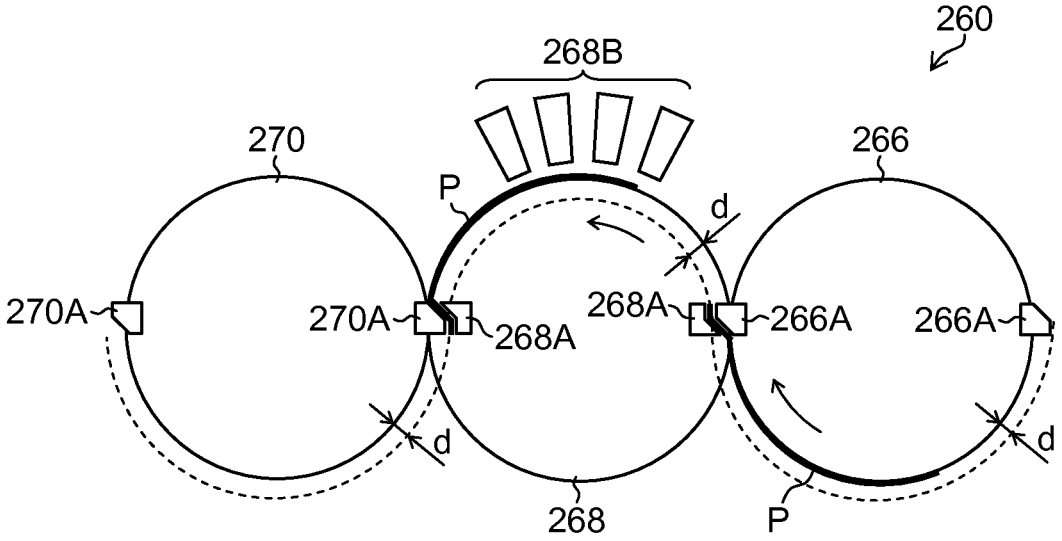
FIGS. 11A and 11B are diagrams explaining passing of the paper sheet.

Specifically, as illustrated in FIG. 11A, in passing the paper sheet P from the transporting barrel 266 to the transporting barrel 268, the passing of the paper sheet P is carried out at a position being protruded outwardly by the distance d from the outer peripheral surface of the transporting barrel 266 and being sunk down inwardly by the distance d from the outer peripheral surface of the transporting barrel 268. The passing from the transporting barrel 262 to the transporting barrel 264 is also similarly carried out.

In passing the paper sheet P from the transporting barrel 268 to the transporting barrel 270, the passing of the paper sheet P is carried out at a position being sunk down inwardly by the distance d from the outer peripheral surface of the transporting barrel 268 and being protruded outwardly by the distance d from the outer peripheral surface of the transporting barrel 270. The passing from the transporting barrel 264 to the transporting barrel 266 is also similarly carried out.

The passing of the paper sheet P is carried out in this way, which allows the leading end portion of the paper sheet P to be continuous.

Figure 11B:
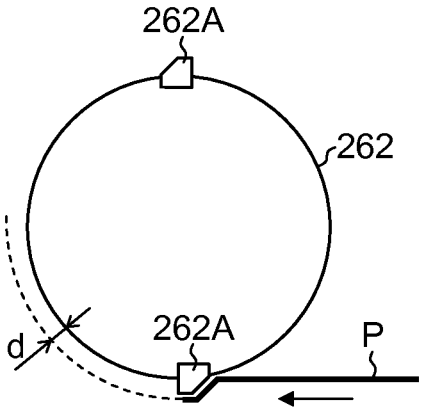

However, the paper sheet transporting device 260 configured in this way is required to achieve simultaneously two functions of positioning and leading end deformation in passing the paper sheet P from the paper feed unit (not illustrated) to the transporting barrel 262. Specifically, as illustrated in FIG. 11B, since the gripper 262A of the transporting barrel 262 is protruded outwardly by the distance d from the outer peripheral surface of the transporting barrel 262, it is required that the leading end of the paper sheet P is accurately positioned at a position of the gripper 262A as well as the leading end of the paper sheet P is formed into a bent shape in order to make the protruded gripper 262A grip the leading end. Therefore, repeatability of positional accuracy of the paper sheet transportation may be problematically degraded.

<Embodiment>

[Outline of Paper Sheet Transporting Device]

Figure 12:
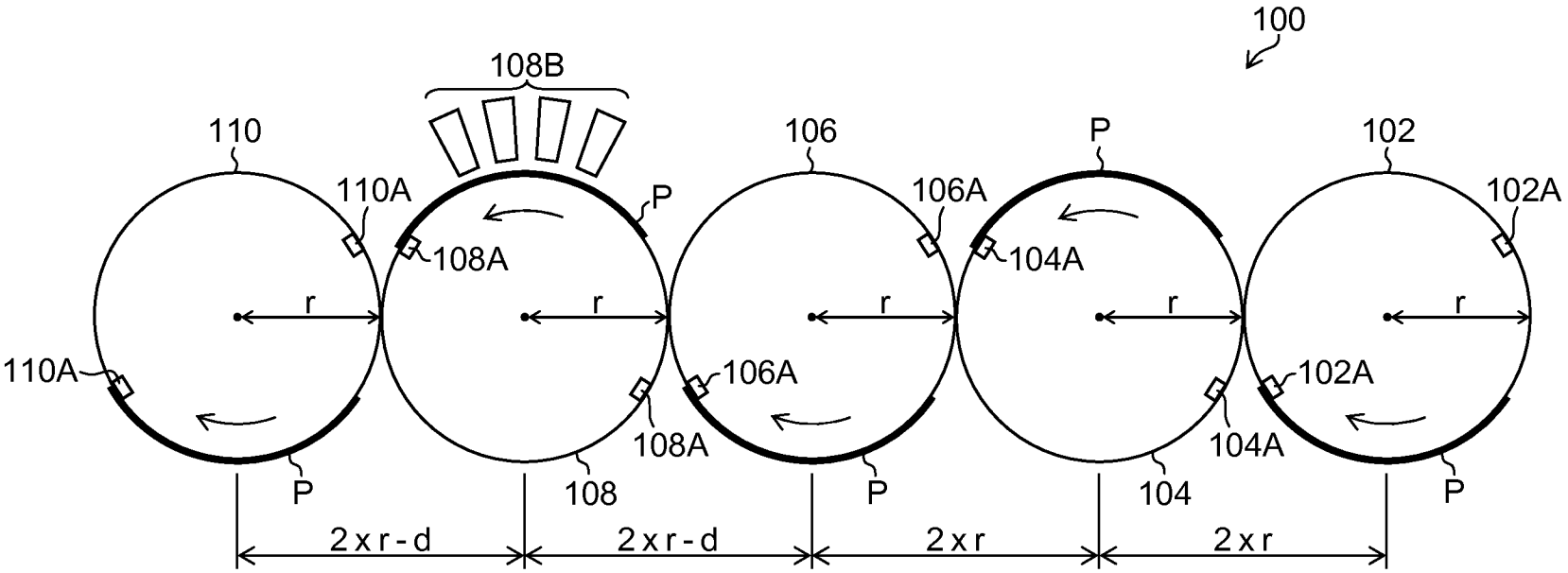
FIG. 12 is a lateral view illustrating the paper sheet transporting device according to the embodiment.

FIG. 12 is a lateral view illustrating a paper sheet transporting device according to the embodiment. A paper sheet transporting device 100 (an example of the recording medium transporting device), which is a device for transporting a paper sheet P (an example of the recording medium) fed from a paper feed unit (not illustrated) to a paper discharge unit (not illustrated), includes transfer barrels 102, 106 (examples of a first transporting barrel) and, 110 (an example of a first transporting barrel), a treatment barrel 104 (an example of a second transporting barrel), and a printing barrel 108.

The transfer barrel 102 receives the paper sheet P from the paper feed unit (not illustrated) and transports the paper sheet P to the treatment barrel 104. The transfer barrel 102 includes a frame member assembled in a cylindrical shape having a radius r and has a gripper 102A on the outer peripheral surface thereof (on a trajectory plane tracked by the radius r) (see FIG. 5). The transfer barrel 102 rotates with gripping by the gripper 102A the leading end of the paper sheet P on the outer peripheral surface thereof to transport the paper sheet P to the treatment barrel 104.

The treatment barrel 104 receives the paper sheet P from the transfer barrel 102 and transports the paper sheet P to the transfer barrel 106. The treatment barrel 104 is formed into a cylindrical shape having the radius r and has a gripper 104A on the outer peripheral surface thereto (see FIG. 5). The treatment barrel 104 rotates with gripping by the gripper 104A the leading end of the paper sheet P on the outer peripheral surface thereof to wind the paper sheet P on the peripheral surface while transporting the paper sheet P to the transfer barrel 106.

The treatment barrel 104 has a plenty of sucking holes (not illustrated) formed on the peripheral surface thereof in a predetermined pattern. The paper sheet P wound on the peripheral surface of the treatment barrel 104 is sucked from the sucking holes to be held by suction on the peripheral surface of the treatment barrel 104 while being transported. This allows the paper sheet P to be transported with flatness being highly kept.

Provided at a position facing a transporting path of the paper sheet P for the treatment barrel 104 is a treatment unit (not illustrated) for subjecting the paper sheet P to various treatments. For example, there is provided a treatment liquid application device for applying the treatment liquid onto the surface to be printed of the paper sheet P or the like. As described above, the treatment barrel 104 transports the paper sheet P with flatness being highly kept, which makes it possible to subject the paper sheet P to a desired treatment.

The transfer barrel 106, similarly to the transfer barrel 102, includes a frame member assembled in a cylindrical shape having the radius r and has a gripper 106A (an example of a grasping unit) on the outer peripheral surface thereof (see FIG. 5). The transfer barrel 106 grips by the gripper 106A the leading end of the paper sheet P received from the treatment barrel 104 to be held on the outer peripheral surface thereof and rotates to transport the paper sheet P to the printing barrel 108.

The printing barrel 108 receives the paper sheet P from the transfer barrel 106 and transports the paper sheet P to the transfer barrel 110. The printing barrel 108 is formed into a cylindrical shape having the radius r, and configured to have a concave so as to sink down the leading end portion of the paper sheet P inwardly by d from the outer peripheral surface and have a gripper 108A (an example of the grasping unit) arranged at a position sunk down inwardly like this (see FIG. 6). The printing barrel 108 rotates with gripping by the gripper 108A the leading end of the paper sheet P on the outer peripheral surface thereof to wind the paper sheet P on the peripheral surface while transporting the paper sheet P to the transfer barrel 110.

The printing barrel 108 has a plenty of sucking holes (not illustrated) formed on the peripheral surface thereof in a predetermined pattern. The paper sheet P wound on the peripheral surface of the printing barrel 108 is sucked from the sucking holes to be held by suction on the peripheral surface of the printing barrel 108 while being transported. This allows the paper sheet P to be transported with flatness being highly kept.

Arranged at a position facing the transporting path of the paper sheet P for printing barrel 108 is an inkjet head 108B for depositing the ink to form an image onto the record surface of the paper sheet P. The printing barrel 108 has the gripper 108A arranged at a position sunk down inwardly, which makes it possible to set the distance TD between the record surface of the paper sheet P and the inkjet head 108B to be small. Since the printing barrel 108 transports the paper sheet P with flatness being highly kept, a high quality image can be formed.

The transfer barrel 110, similarly to the transfer barrel 102, includes a frame member assembled in a cylindrical shape having the radius r and has a gripper 110A (an example of the grasping unit) on the outer peripheral surface thereof (see FIG. 5). The transfer barrel 110 grips by the gripper 110A the leading end of the paper sheet P received from the printing barrel 108 on the outer peripheral surface thereof and rotates to transport the paper sheet P to the paper discharge unit (not illustrated).

The grippers 102A, 104A, 106A, 108A, and 110A, each gripper provided in plural number, of the transfer barrel 102, treatment barrel 104, the transfer barrel 106, the printing barrel 108, and the transfer barrel 110, respectively, are provided across the length corresponding to the maximum width of the paper sheet P at certain intervals in a direction perpendicular to the transporting direction of the paper sheet P (see FIG. 3 and FIG. 4). Each barrel has rows of the grippers each of which row is arranged on the outer peripheral surface of the barrel at two locations symmetric about the rotation shaft, and is configured such that two paper sheets P can be transported per one rotation.

The plural grippers of each barrel and the plural grippers passing the paper sheet P to the relevant barrel are arranged alternately in a direction perpendicular to the transporting direction of the paper sheet P (see FIG. 3 and FIG. 4). These two barrels are driven such that their timings of receiving and passing the paper sheet P coincide with each other and such that positions of their gripper rows match each other. In passing the paper sheet P, the grippers of two barrels are both (simultaneously) brought into a state of grasping the leading end portion of the paper sheet P.

The inter-shaft distance between the transfer barrel 102 and the treatment barrel 104, and the inter-shaft distance between the treatment barrel 104 and the transfer barrel 106 are set to be 2×r (corresponding to a sum of a radius of the transfer barrel 102 and a radius of the treatment barrel 104, and a sum of a radius of the treatment barrel 104 and a radius of the transfer barrel 106, respectively), as well as the inter-shaft distance between the transfer barrel 106 and the printing barrel 108, and the inter-shaft distance between the printing barrel 108 and the transfer barrel 110 are set to be 2×r−d (corresponding to a distance shorter by the distance d than a sum of a radius of the transfer barrel 106 and a radius of the printing barrel 108, and a distance shorter by the distance d than a sum of a radius of the printing barrel 108 and a radius of the transfer barrel 110, respectively).

[Outline of Rotary Drive Mechanism]

Figure 13:
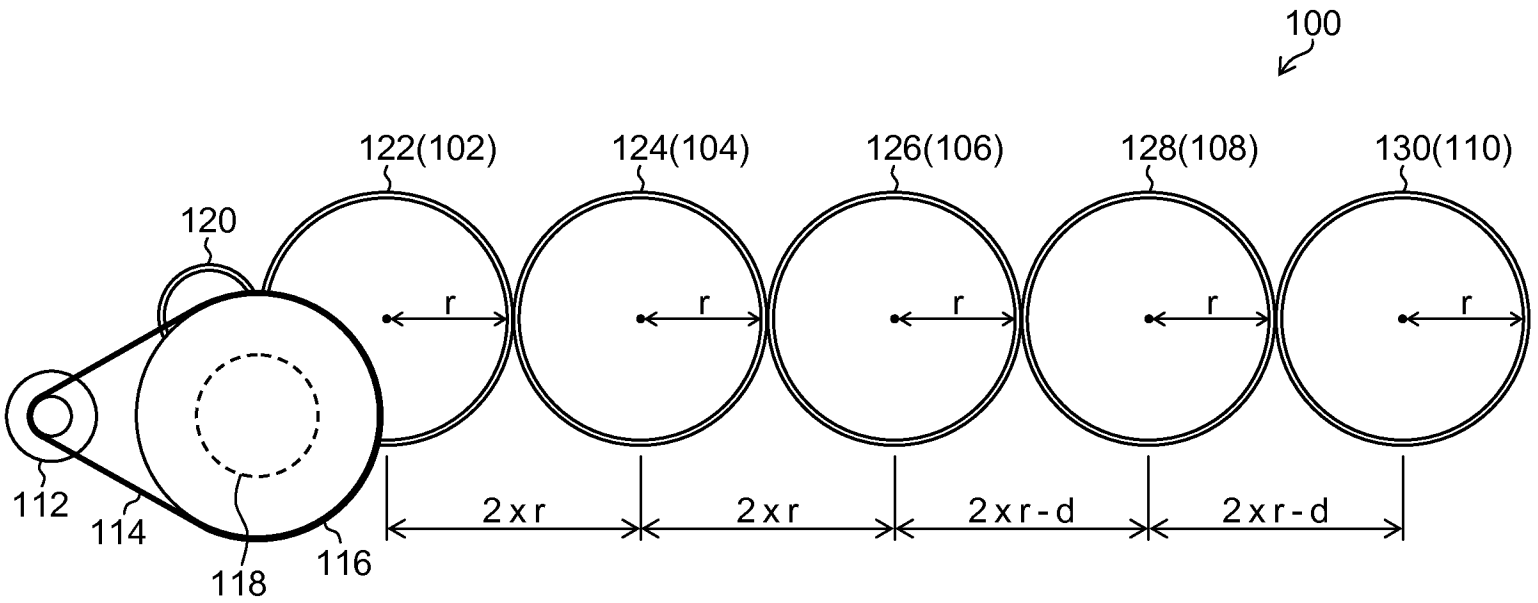
FIG. 13 is a configuration diagram of the rotary drive mechanism of the paper sheet transporting device according to the embodiment.

FIG. 13 is a configuration diagram of a rotary drive mechanism provided on a lateral side portion opposite to that illustrated in FIG. 12. As illustrated in the figure, the paper sheet transporting device 100 has a motor 112 for rotation provided as a motive power source for the paper sheet transporting system. Motive power from the motor 112 for rotation is transmitted via a timing belt 114 to a pulley 116.

The pulley 116 is integrally coupled in a concentric manner with a toothed wheel 118, and thus, the pulley 116 and the toothed wheel 118 rotate together. The toothed wheel 118 engages with a toothed wheel 120 which is provided at the upper left of the toothed wheel 118 in FIG. 13, and the toothed wheel 120 engages with a toothed wheel 122 directly coupled in a concentric manner with a rotation shaft of the transfer barrel 102.

The toothed wheel 122 of the transfer barrel 102 engages with a toothed wheel 124 which is directly coupled in a concentric manner with a rotation shaft of the treatment barrel 104, and the toothed wheel 124 engages with a toothed wheel 126 which is directly coupled in a concentric manner with a rotation shaft of the transfer barrel 106. Subsequently, the toothed wheel 126 engages with a toothed wheel 128 which is directly coupled in a concentric manner with a rotation shaft of the printing barrel 108, and the toothed wheel 128 engages with a toothed wheel 130 which is directly coupled in a concentric manner with a rotation shaft of the transfer barrel 110.

The respective toothed wheels 122 to 130, each of which is a toothed wheel for rotation of the each barrel, are configured to be interlocked (directly engaged) with one another. The motive power from the motor 112 for rotation is transmitted via the timing belt 114, the pulley 116, and the toothed wheels 118 and 120 to the respective toothed wheels 122 to 130, and these toothed wheels 122 to 130 work in conjunction with one another to rotate the transfer barrel 102, the treatment barrel 104, the transfer barrel 106, the printing barrel 108, and the transfer barrel 110.

The respective toothed wheels 122 to 130 are each configured to have the radius r. The inter-shaft distance between the transfer barrel 102 and the treatment barrel 104, and the inter-shaft distance between the treatment barrel 104 and the transfer barrel 106 are set to be 2×r. Further, the inter-shaft distance between the transfer barrel 106 and the printing barrel 108, and the inter-shaft distance between the printing barrel 108 and the transfer barrel 110 are set to be 2×r−d with a drive ratio being maintained by shifting the toothed wheel 128.

In this way, a diameter of each of the transfer barrel 102, the treatment barrel 104, the transfer barrel 106, the printing barrel 108, and the transfer barrel 110 matches a diameter of each of the toothed wheels 122 to 130 (pitch circle diameter), and thus, when the transfer barrel 102 rotates one revolution, the treatment barrel 104, the transfer barrel 106, the printing barrel 108, the transfer barrel 110 also rotate one revolution.

Note that a helical toothed wheel is used as a toothed wheel of a motive power transmission member for rotating the transfer barrel 102, the treatment barrel 104, the transfer barrel 106, the printing barrel 108, and the transfer barrel 110. A spur toothed wheel can be used as a toothed wheel, but it is preferable to employ a helical toothed wheel and a double helical toothed wheel in order to carry out smooth motive power transmission. The helical toothed wheel, which has a teeth portion formed to be oblique, can achieve the smooth motive power transmission. The double helical toothed wheel has an advantage in that a force in a thrust direction can be reduced as compared with the helical toothed wheel, but requires higher costs than the helical toothed wheel. Therefore, in this example, the helical toothed wheel is employed in view of satisfying both the smooth motive power transmission and lower costs.

[Trajectory of Leading End Portion of Paper Sheet]

Figure 14:
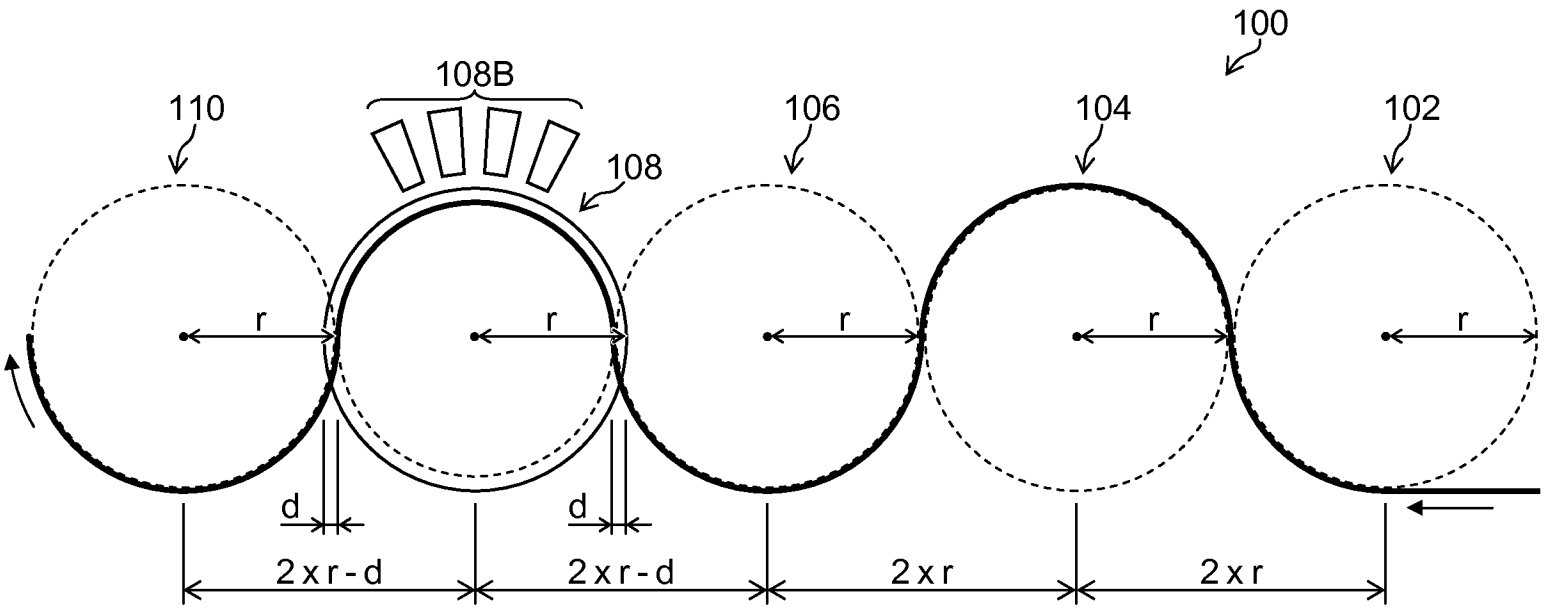
FIG. 14 is a diagram illustrating transportation of the paper sheet by the paper sheet transporting device according to the embodiment.

FIG. 14 is a diagram illustrating transportation of the paper sheet P in the paper sheet transporting device 100. In the figure, a solid line represents a trajectory of the leading end portion of the paper sheet P, and a chain line represents a drive pitch circle of the toothed wheel of each barrel.

From the transfer barrel 102 to the treatment barrel 104, the leading end of the paper sheet P is passed from the outer peripheral surface of the transfer barrel 102 to the outer peripheral surface of the treatment barrel 104 by way of a row of the plural grippers 102A and a row of the plural grippers 104A, the rows aligning on the same line. Therefore, the trajectory of the leading end portion of the paper sheet P is continuous, and the passing of the paper sheet P is carried out with no paper sheet deformation (waving) being generated.

Similarly, from the treatment barrel 104 to the transfer barrel 106 also, the leading end of the paper sheet P is passed from the outer peripheral surface of the treatment barrel 104 to the outer peripheral surface of the transfer barrel 106 by way of a row of the plural grippers 104A and a row of the plural grippers 106A, the rows aligning on the same line. Therefore, the trajectory of the leading end portion of the paper sheet P is continuous, and the passing of the paper sheet P is carried out with no paper sheet deformation being generated.

From the transfer barrel 106 to the printing barrel 108, the leading end of the paper sheet P is passed from the outer peripheral surface of the transfer barrel 106 to an inner side that is inward by d from the outer peripheral surface of the printing barrel 108 by way of the grippers 106A and the grippers 108A.

Figure 15A:
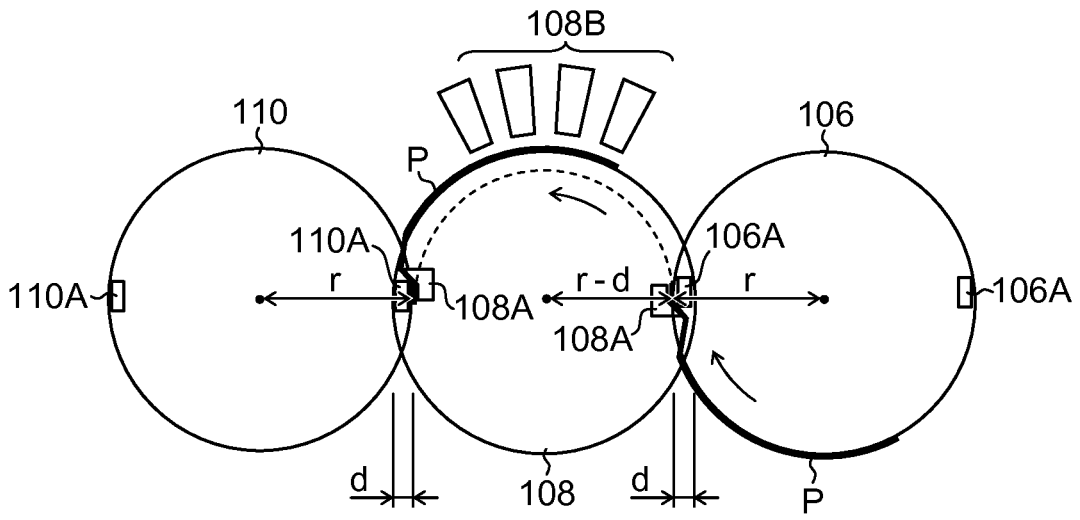
FIGS. 15A and 15 B are diagrams explaining passing of the paper sheet according to the embodiment.

Here, since the inter-shaft distance between the transfer barrel 106 and the printing barrel 108 is set to be 2×r−d, a row of the plural grippers 106A and a row of the plural grippers 108A align on the same line at a position that is inward by d from the outer peripheral surface of the printing barrel 108 as illustrated in FIG. 15A, and thus, the trajectory of the leading end portion of the paper sheet P is continuous and the passing of the paper sheet P is carried out with no paper sheet deformation being generated.

Further, from the printing barrel 108 to the transfer barrel 110 also, the leading end of the paper sheet P is passed from the inner side that is inward by d from the outer peripheral surface of printing barrel 108 to the outer peripheral surface of the transfer barrel 110 by way of the grippers 108A and the grippers 110A.

Here, since the inter-shaft distance between the printing barrel 108 and the transfer barrel 110 is set to be 2×r−d, a row of the plural grippers 108A and a row of the plural grippers 110A align on the same line at a position that is inward by d from the outer peripheral surface of the printing barrel 108 as illustrated in FIG. 15A, and thus, the trajectory of the leading end portion of the paper sheet P is continuous and the passing of the paper sheet P is carried out with no paper sheet deformation being generated.

Figure 15B:
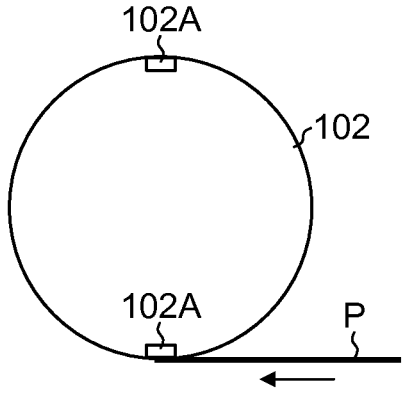

Since the paper sheet P is pinched between the gripper 102A of the transfer barrel 102 and the outer peripheral surface of the transfer barrel 102, the paper sheet leading end is not required to be deformed, and thus, the passing may be carried out by way of positioning in passing the paper sheet P from the paper feed unit (not illustrated) to the transfer barrel 102 as illustrated in FIG. 15B.

In this way, according to the paper sheet transporting device 100, the arrangement of the grippers of the printing barrel sunk down inwardly from the outer peripheral surface of the printing barrel enables high-definition inkjet printing by the inkjet head arranged facing the printing barrel. Moreover, paper sheet distortion can be suppressed to be small and a degree of contact of the paper sheet with the barrel can be increased, which enables the high-definition inkjet printing. Further, the inter-shaft distances between the printing barrel and the barrels at stages prior to and subsequent to the printing barrel are set to be shorter by an amount involved by arranging inwardly the grippers of the printing barrel with the drive ratio being maintained by shifting the toothed wheel of the printing barrel, and other inter-shaft distances between the transporting barrels than those described above are set to be a sum of the radiuses of these transporting barrels, which makes it possible to arrange the grippers of the barrels other than the printing barrel on the outer peripheral surfaces of the respective barrels, allowing the stable transportation.

Figure 16:
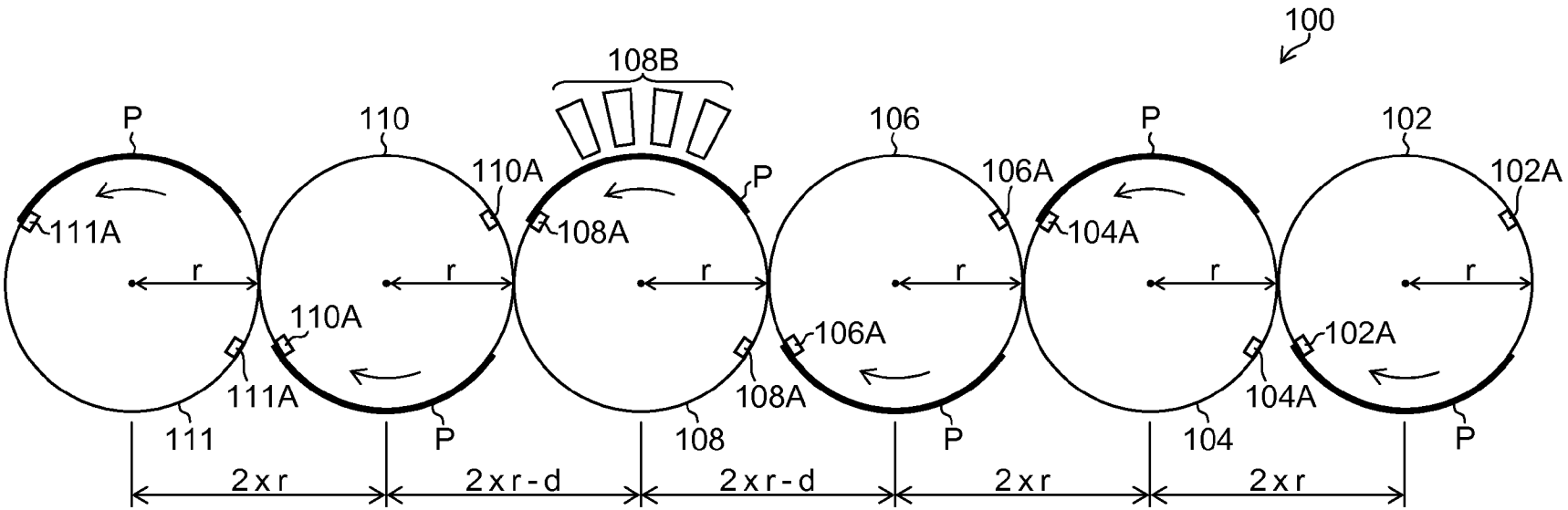
FIG. 16 a lateral view illustrating a modification example of the paper sheet transporting device according to the embodiment.

Here, the paper sheet P is passed from the transfer barrel 110 to the paper discharge unit (not illustrated), but in a case where a transfer barrel 111 gripping the paper sheet P on the outer peripheral surface (an example of the second transporting barrel) is arranged at a stage subsequent to the transfer barrel 110 as in a modification example illustrated in FIG. 16, the inter-shaft distance between the transfer barrel 111 and the transfer barrel 110 may be set to be a sum of a radius of the transfer barrel 111 and a radius of the transfer barrel 110. A gripper 111A of the transfer barrel 111, similarly to the transfer barrel 102, the treatment barrel 104, the transfer barrel 106, the printing barrel 108, and the transfer barrel 110, is provided in plural number across the length corresponding to the maximum width of the paper sheet P at certain intervals in a direction perpendicular to the transporting direction of the paper sheet P. The transfer barrel 111 has rows of the grippers 111A each of which row is arranged on the outer peripheral surface of the barrel at two locations symmetric about the rotation shaft, and is configured such that two paper sheets P can be transported per one rotation.

<Application to Inkjet Recording Device>

Figure 17:
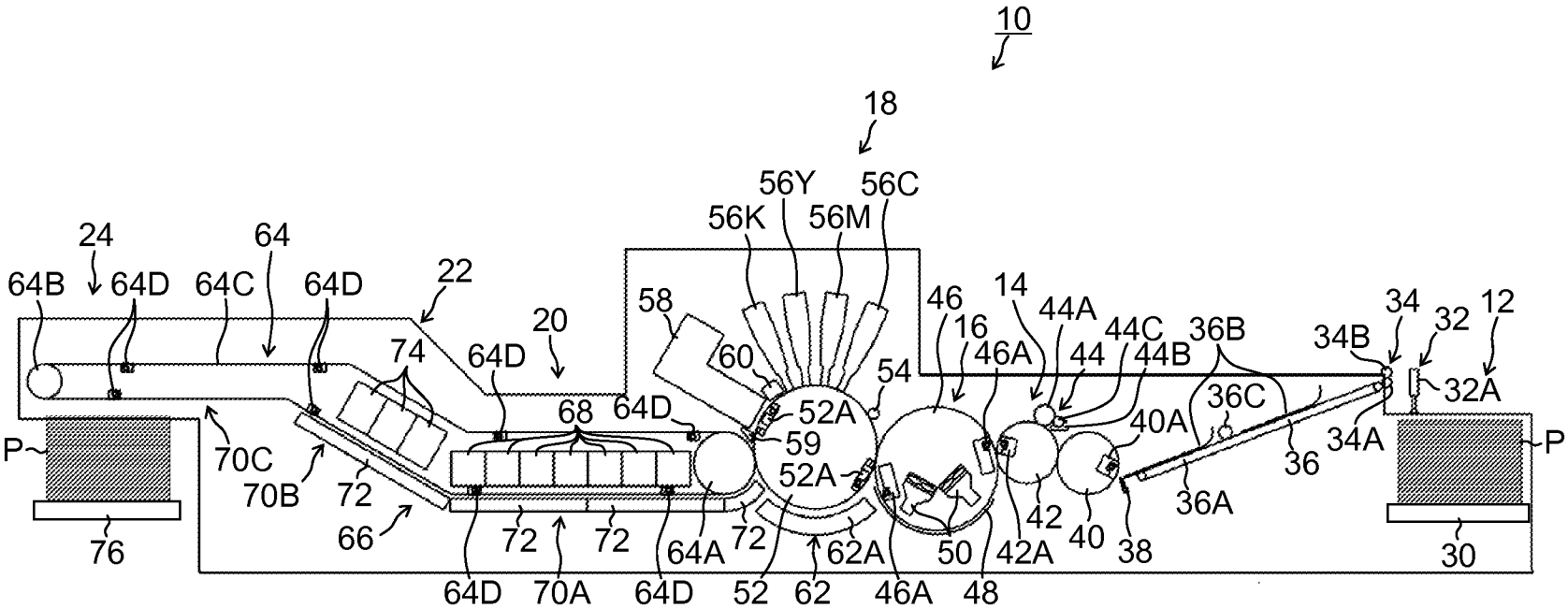
FIG. 17 is a general configuration diagram illustrating an embodiment of an inkjet recording device according to the embodiment.

FIG. 17 is a general configuration diagram illustrating an embodiment of an inkjet recording device according to the embodiment.

The inkjet recording device 10, which is an inkjet recording device using an aqueous UV ink (UV (ultraviolet) curable ink using an aqueous vehicle) to record an image on a printer sheet of paper sheet P (recording medium) by inkjet printing, is configured to mainly include a paper feed unit 12 for feeding a paper sheet P, a treatment liquid application unit 14 for applying a predetermined treatment liquid onto a surface (image record surface) of the paper sheet P fed from the paper feed unit 12, a treatment liquid drying treatment unit 16 for subjecting the paper sheet P applied with the treatment liquid by the treatment liquid application unit 14, an image recording unit 18 for recording an image by inkjet printing using the aqueous UV ink onto the surface of the paper sheet P having undergone a drying treatment by the treatment liquid drying treatment unit 16, an ink drying treatment unit 20 for subjecting the paper sheet P having the image recorded thereon by the image recording unit 18 to the drying treatment, a UV irradiating treatment unit 22 for subjecting the paper sheet P having undergone the drying treatment by the ink drying treatment unit 20 to a UV irradiation treatment (fixing treatment) to fix the image, and a paper discharge unit 24 for discharging the paper sheet P having undergone the UV irradiation treatment by the UV irradiating treatment unit 22.

<Paper Feed Unit>

The paper feed unit 12 feeds the paper sheet P stacked on a paper feed platform 30 one by one to the treatment liquid application unit 14. The paper feed unit 12 is configured to mainly include the paper feed platform 30, a sucking device (sucker) 32, a paper feed roller pair 34, a feeder board 36, a front stop 38, and a paper feed drum 40.

The paper sheet P is placed on the paper feed platform 30 in a state of a stack in which plenty of sheets are piled up. The paper feed platform 30 is provided so as to be capable of being lifted and lowered by a paper feed platform lifting and lowering device (not illustrated). The paper feed platform lifting and lowering device is controlled to be driven in conjunction with increase and decrease of the paper sheets P stacked on the paper feed platform 30 to lift and lower the paper feed platform 30 such that the paper sheet P placed on the top of the stack is always positioned at a certain height.

The paper sheet P as the recording medium is not specifically limited, but a general purpose printing sheet used for general offset printing (paper sheet mainly made from cellulose such as so-called high-quality paper, coat paper, and art paper) can be used. In this example, coated paper is used. The coated paper is generally made by applying coating materials to give a coat layer onto a surface of high-quality paper, neutralized paper or the like not having undergone a surface treatment. Concretely, the art paper, coat paper, light weight coat paper, ultra-light weight coated paper and the like are preferably used.

The sucking device (sucker) 32 takes the paper sheets P stacked on the paper feed platform 30 sequentially from the top one by one to feed to the paper feed roller pair 34. The sucking device (sucker) 32, which includes a suction foot 32A provided liftably and swingably, holds a top surface of the paper sheet P by suction by the suction foot 32A to transport the paper sheet P from the paper feed platform 30 to the paper feed roller pair 34. At this time, the suction foot 32A holds a leading end side of the top surface of the paper sheet P placed on the top of the stack by suction to lift the paper sheet P and insert a leading end of the lifted paper sheet P between a pair of rollers 34A and 34B included in the paper feed roller pair 34.

The paper feed roller pair 34 includes the vertical pair of rollers 34A and 34B which are pressed and abutted against each other. The vertical pair of rollers 34A and 34B has a driving roller (roller 34A) as one of the pair and a driven roller (roller 34B) as the other. The driving roller (roller 34A) is driven by a motor (not illustrated) to be rotated. The motor is driven in conjunction of feeding of the paper sheet P so as to rotate the driving roller (roller 34A) at a timing when the paper sheet P is fed from the sucking device (sucker) 32. The paper sheet P inserted between the vertical pair of rollers 34A and 34B is nipped by the rollers 34A and 34B to be fed in a rotation direction of the rollers 34A and 34B (direction in which the feeder board 36 is arranged).

The feeder board 36, which is formed corresponding to a paper width, receives the paper sheet P fed from the paper feed roller pair 34 and guides to the front stop 38. The feeder board 36 is arranged so that the leading end side thereof is inclined downward, and slides the paper sheet P placed on a transporting surface of the feeder board 36 to guide to the front stop 38 along the transporting surface.

The feeder board 36 is provided with a plurality of tape feeders 36A arranged at intervals in a width direction for transporting the paper sheet P. The tape feeder 36A is formed to have no ends and driven by a motor (not illustrated) to be rotated. The paper sheet P placed on the transporting surface of the feeder board 36 is given a feed by the tape feeder 36A to be transported on the feeder board 36.

On the feeder board 36, a retainer 36B and a rolling member 36C are arranged.

A plurality of retainers 36B (two in the example) are arranged in tandem, front and back, along a transporting surface of the paper sheet P. The retainer 36B includes a leaf spring having a width corresponding to the paper width, and arranged to be pressed and abutted against the transporting surface. The paper sheet P being transported on the feeder board 36 by the tape feeder 36A is passed through the retainer 36B to correct irregularity thereof. The retainer 36B is formed to have a trailing end curled in order to easily insert the paper sheet P between the feeder board 36 and the retainer 36B.

The rolling member 36C is arranged between the front and back retainers 36B. The rolling member 36C is arranged so as to be pressed and abutted against the transporting surface of the paper sheet P. The paper sheet P being transported between the front and back retainers 36B is transported with the top surface being held by the rolling member 36C.

The front stop 38 corrects an attitude of the paper sheet P. The front stop 38 is formed into a plate-shape and arranged perpendicularly to a transporting direction of the paper sheet P. The front stop 38 is arranged swingably to be driven by a motor (not illustrated). The paper sheet P transported on the feeder board 36, whose leading end is abutted against the front stop 38, is corrected in attitude (so-called skew prevention). The front stop 38 swings in conjunction with feeding the paper sheet to the paper feed drum 40 to pass the paper sheet P corrected in attitude to the paper feed drum 40.

The paper feed drum 40 receives the paper sheet P fed from the feeder board 36 via the front stop 38 to transport to the treatment liquid application unit 14. The paper feed drum 40 is formed into a cylindrical shape and is rotated by a rotary drive mechanism described later (see FIG. 18). The paper feed drum 40 has a gripper 40A provided on an outer peripheral surface thereof, and the gripper 40A grips the leading end of the paper sheet P. The paper feed drum 40 rotates with gripping by the gripper 40A the leading end of the paper sheet P to wind the paper sheet P on the peripheral surface while transporting the paper sheet P to the treatment liquid application unit 14.

The paper feed unit 12 is configured as described above. The paper sheets P stacked on the paper feed platform 30 are lifted by the sucking device (sucker) 32 sequentially from the top one by one to be fed to the paper feed roller pair 34. The paper sheet P fed to the paper feed roller pair 34 is fed forward by the vertical pair of rollers 34A and 34B included in the paper feed roller pair 34 to be placed on the feeder board 36. The paper sheet P placed on the feeder board 36 is transported by the tape feeder 36A provided on the transporting surface of feeder board 36. In this transporting course, the paper sheet P is pressed against the transporting surface of the feeder board 36 by the retainer 36B to correct irregularity. The paper sheet P transported by the feeder board 36 abuts on the front stop 38 at the leading end thereof to be corrected in inclination, and thereafter, passed to the paper feed drum 40. Then, the paper feed drum 40 transports the paper sheet P to the treatment liquid application unit 14.

<Treatment Liquid Application Unit>

The treatment liquid application unit 14 deposits the predetermined treatment liquid onto a surface of the paper sheet P (image record surface). The treatment liquid application unit 14 is configured to mainly include a treatment liquid deposition drum 42 for transporting the paper sheet P and a treatment liquid deposition unit 44 for depositing a predetermined treatment liquid onto a printing surface of the paper sheet P being transported by the treatment liquid deposition drum 42.

The treatment liquid deposition drum 42 receives the paper sheet P from the paper feed drum 40 in the paper feed unit 12 to transport the paper sheet P to the treatment liquid drying treatment unit 16. The treatment liquid deposition drum 42 is formed into a cylindrical shape and is rotated by the rotary drive mechanism described later (see FIG. 18). The treatment liquid deposition drum 42 has a gripper 42A on an outer peripheral surface thereof, and the gripper 42A grips the leading end of the paper sheet P. The treatment liquid deposition drum 42 rotates with gripping the leading end of the paper sheet P by the gripper 42A to wind the paper sheet P on the peripheral surface while transporting the paper sheet P to the treatment liquid drying treatment unit 16 (one paper sheet P is transported per one rotation). The treatment liquid deposition drum 42 and the paper feed drum 40 are controlled to be rotated such that their timings of receiving and passing the paper sheet P coincide with each other. In other words, these drums are driven to have the same circumferential speed and driven such that positions of their grippers match each other.

The treatment liquid deposition unit 44 applies the treatment liquid by roller onto the surface of the paper sheet P being transported by the treatment liquid deposition drum 42. The treatment liquid deposition unit 44 is configured to mainly include an application roller 44A for applying the treatment liquid onto the paper sheet P, a treatment liquid tank 44B for reserving the treatment liquid, and a drawing roller 44C for drawing the treatment liquid reserved in the treatment liquid tank 44B to supply to the application roller 44A. The drawing roller 44C is arranged to be pressed and abutted against the application roller 44A and arranged to have a part thereof immersed in the treatment liquid reserved in the treatment liquid tank 44B. The drawing roller 44C measures and draws the treatment liquid to deposit the treatment liquid of a certain thickness onto a peripheral surface of application roller 44A. The application roller 44A is provided corresponding to the paper width, and pressed and abutted against the paper sheet P to apply the treatment liquid deposited onto the peripheral surface thereof onto the paper sheet P. The application roller 44A is driven by an abutting and separation mechanism (not illustrated) to be moved between an abutting position where to abut the peripheral surface of the treatment liquid deposition drum 42 and a separating position where to separate from the peripheral surface of the treatment liquid deposition drum 42. The abutting and separation mechanism moves the application roller 44A at a timing when the paper sheet P is passing and applies the treatment liquid onto the surface of the paper sheet P being transported by the treatment liquid deposition drum 42.

Note that in this example, the configuration is such that the treatment liquid is applied by roller, but a method for depositing the treatment liquid is not limited thereto. Other than this configuration, a configuration in which deposition is carried out by use of an inkjet head or a configuration in which deposition is carried out by spraying may be also employed.

The treatment liquid application unit 14 is configured as described above. The paper sheet P passed from the paper feed drum 40 in the paper feed unit 12 is received by the treatment liquid deposition drum 42. The treatment liquid deposition drum 42 rotates with gripping the leading end of the paper sheet P by the gripper 42A to wind the paper sheet P on the peripheral surface for transporting. In this transporting course, the application roller 44A is pressed and abutted against the surface of the paper sheet P to apply the treatment liquid onto the surface of the paper sheet P.

Here, as the treatment liquid applied onto the surface of the paper sheet P, a treatment liquid is used which has a function to aggregate coloring materials in the aqueous UV ink whose droplets is to be deposited onto the paper sheet P in the image recording unit 18 at a subsequent stage. Application of such a treatment liquid onto the surface of the paper sheet P and deposition of the ink droplets of the aqueous UV ink allow an image of high quality to be printed without occurrence of landed ink droplets interference or the like even in a case where the general purpose printing sheet is used.

<Treatment Liquid Drying Treatment Unit>

The treatment liquid drying treatment unit 16 subjects the paper sheet P having the surface applied with treatment liquid to the drying treatment. This treatment liquid drying treatment unit 16 is configured to mainly include a treatment liquid drying treatment drum 46 for transporting the paper sheet P, a paper transporting guide 48, and a treatment liquid drying treatment unit 50 for blowing hot air to the printing surface, so as to be dried, of the paper sheet P being transported by the treatment liquid drying treatment drum 46.

The treatment liquid drying treatment drum 46 receives the paper sheet P from the treatment liquid deposition drum 42 in the treatment liquid application unit 14 to transport the paper sheet P to the image recording unit 18. The treatment liquid drying treatment drum 46 includes a frame member assembled in a cylindrical shape and is rotated by a rotary drive mechanism described later (see FIG. 17). The treatment liquid drying treatment drum 46 has a gripper 46A on an outer peripheral surface thereof, and the gripper 46A grips the leading end of the paper sheet P. The treatment liquid drying treatment drum 46 rotates with gripping the leading end of the paper sheet P by the gripper 46A to wind the paper sheet P on the peripheral surface while transporting the image recording unit 18 and the paper sheet P. Note that the treatment liquid drying treatment drum 46 in this example has the gripper 46A arranged at each of two points on the outer peripheral surface thereof to be configured such that two paper sheets P can be transported per one rotation. The treatment liquid drying treatment drum 46 and the treatment liquid deposition drum 42 are controlled to be rotated such that their timings of receiving and passing the paper sheet P coincide with each other. In other words, these drums are driven to have the same circumferential speed and driven such that positions of their grippers match each other.

The paper transporting guide 48 is arranged along a transporting path of the paper sheet P relating to the treatment liquid drying treatment drum 46 to guide the paper sheet P being transported.

The treatment liquid drying treatment unit 50, which is arranged inside the treatment liquid drying treatment drum 46, blows the hot air to the surface of the paper sheet P being transported by the treatment liquid drying treatment drum 46 to carry out the drying treatment. This example has a configuration in which two treatment liquid drying treatment units 50 are arranged inside the treatment liquid drying treatment drum and blow the hot air to the surface of the paper sheet P being transported by the treatment liquid drying treatment drum 46.

The treatment liquid drying treatment unit 16 is configured as described above. The paper sheet P passed from the treatment liquid deposition drum 42 in the treatment liquid application unit 14 is received by the treatment liquid drying treatment drum 46. The treatment liquid drying treatment drum 46 rotates with gripping the leading end of the paper sheet P by the gripper 46A to transport the paper sheet P. At this time, the treatment liquid drying treatment drum 46 carries out transporting with the surface of the paper sheet P (surface applied with the treatment liquid) facing the inner side. The paper sheet P, in a course of being transported by the treatment liquid drying treatment drum 46, is subjected to the drying treatment in which the surface thereof receives the hot air blown from the treatment liquid drying treatment unit 50 arranged inside the treatment liquid drying treatment drum 46. In other words, solvent components in the treatment liquid are removed. This forms an ink aggregation layer on the surface of the paper sheet P.

<Image Recording Unit>

The image recording unit 18 deposits liquid droplets of ink (aqueous UV ink) of each of colors C, M, Y, and K onto the printing surface of the paper sheet P to render a color image on the printing surface of the paper sheet P. The image recording unit 18 is configured to include an image recording drum 52 for transporting the paper sheet P, a paper pressing roller 54 for pressing the paper sheet P being transported by the image recording drum 52 to bring the paper sheet P into tight contact with a peripheral surface of the image recording drum 52 (medium-holding device, medium-transporting device), inkjet heads 56C, 56M, 56Y, and 56K for ejecting and depositing ink droplets of each of colors C, M, Y, and K onto the paper sheet P, an inline sensor 58 for reading out the image recorded on the paper sheet P, a mist filter 60 for catching ink mist, and a drum cooling unit 62.

The image recording drum 52 (an example of the printing barrel) receives the paper sheet P from the treatment liquid drying treatment drum 46 in the treatment liquid drying treatment unit 16 to transport the paper sheet P to the ink drying treatment unit 20. The image recording drum 52 is formed into a cylindrical shape and is rotated by the rotary drive mechanism described later (see FIG. 18). The image recording drum 52 has a gripper 52A provided at a position sunk down inwardly from an outer peripheral surface thereof. The gripper 52A grips the leading end of the paper sheet P inwardly by the distance d from the outer peripheral surface of the image recording drum 52. The image recording drum 52 rotates with gripping by the gripper 52A the leading end of the paper sheet P to wind the paper sheet P on the peripheral surface while transporting the paper sheet P to the ink drying treatment unit 20. The image recording drum 52 has a plenty of sucking holes (not illustrated) formed on the peripheral surface thereof in a predetermined pattern. The paper sheet P wound on the peripheral surface of the image recording drum 52 is sucked from the sucking holes to be held by suction on the peripheral surface of the image recording drum 52 while being transported. This allows the paper sheet P to be transported with flatness being highly kept.

Sucking from the sucking holes works only in a certain range, that is, works between a predetermined sucking start position and a predetermined sucking end position. The sucking start position is set to an arrangement position of the paper pressing roller 54, and the sucking end position is set on the downstream side of an arrangement position of the inline sensor 58 (e.g., set to a position where the paper sheet is passed to the ink drying treatment unit 20). In other words, the setting is made such that the paper sheet P is held by suction on the peripheral surface of the image recording drum 52 at least at the arrangement positions of the inkjet heads 56C, 56M, 56Y, and 56K (image record position), and the arrangement position of the inline sensor 58 (image readout position).

A mechanism for holding the paper sheet P by suction on the peripheral surface of the image recording drum 52 is not limited to a suction method owing to a negative pressure described above, but a method owing to electrostatic suction may be employed.

The image recording drum 52 in this example has the gripper 52A arranged on the outer peripheral surface thereof at each of two locations to be configured such that two paper sheets P can be transported per one rotation. The image recording drum 52 and the treatment liquid drying treatment drum 46 are controlled to be rotated such that their timings of receiving and passing the paper sheet P coincide with each other. In other words, these drums are driven to have the same circumferential speed and driven such that positions of their grippers match each other.

The paper pressing roller 54 is arranged in the vicinity of a paper receiving position of the image recording drum 52 (position at which the paper sheet P is received from the treatment liquid drying treatment drum 46). The paper pressing roller 54, which is formed of a rubber roller, is arranged to be pressed and abutted against the peripheral surface of the image recording drum 52. The paper sheet P passed from the treatment liquid drying treatment drum 46 to the image recording drum 52 is passed through the paper pressing roller 54 to be nipped and then brought into tight contact with the peripheral surface of the image recording drum 52.

Four inkjet heads 56C, 56M, 56Y, and 56K are arranged at certain intervals along the transporting path of the paper sheet P relating to the image recording drum 52. Each of the inkjet heads 56C, 56M, 56Y, and 56K is formed of a line head corresponding to the paper width, and is arranged such that a nozzle face faces the peripheral surface of the image recording drum 52. Each of inkjet heads 56C, 56M, 56Y, and 56K ejects liquid droplets of ink from a nozzle array formed at the nozzle face toward the image recording drum 52 to record an image on the paper sheet P being transported by the image recording drum 52.

The aqueous UV ink is used for the ink ejected from each of the inkjet heads 56C, 56M, 56Y, and 56K as described above. The aqueous UV ink can be cured by being irradiated with ultraviolet (UV) rays after ink droplets deposition.

The inline sensor 58 is arranged on the downstream side of the tail end inkjet head 56K with respect to the transporting direction of the paper sheet P by the image recording drum 52 to read out the image recorded by the inkjet heads 56C, 56M, 56Y, and 56K. The inline sensor 58, which is formed of a line scanner, for example, reads out the image recorded by the inkjet heads 56C, 56M, 56Y, and 56K from the paper sheet P being transported by the image recording drum 52.

Note that a contact prevention plate 59 is arranged on the downstream side of the inline sensor 58 in the vicinity of the inline sensor 58. The contact prevention plate 59 prevents the paper sheet P from being brought into contact with the inline sensor 58 in a case of coming-off of the paper sheet P due to transporting failure or the like.

The mist filter 60 is arranged between the tail end inkjet head 56K and the inline sensor 58 to suck an air around the image recording drum 52 for catching the ink mist. In this way, sucking the air around the image recording drum 52 for catching the ink mist can prevent the ink mist from entering the inline sensor 58 and can prevent read-out failure or the like from occurring.

The drum cooling unit 62 blows a cold air to the image recording drum 52 to cool the image recording drum 52. The drum cooling unit 62 is configured to mainly include an air-conditioner (not illustrated), and a duct 62A for blowing a cool air supplied from the air-conditioner to the peripheral surface of the image recording drum 52. The duct 62A blows the cool air to the area of the image recording drum 52 except for an area through which the paper sheet P is transported to cool the image recording drum 52. The configuration in this example is such that since the paper sheet P is transported along a surface of an arc of an approximately upper half of the image recording drum 52, the duct 62A blows the cool air to an area of an approximately lower half of the image recording drum 52 to cool the image recording drum 52. Specifically, a blowing-out opening of the duct 62A is formed into an arc-shape so as to cover an approximately lower half of the image recording drum 52 to be configured such that the cool air is blown to the area of an approximately lower half of the image recording drum 52.

Here, a temperature for cooling the image recording drum 52 is set in relation to a temperature of the inkjet heads 56C, 56M, 56Y, and 56K (particularly, temperature of the nozzle face), and the image recording drum is cooled to have a temperature lower than that of inkjet heads 56C, 56M, 56Y, and 56K. This can prevent dew condensation from occurring on the inkjet heads 56C, 56M, 56Y, and 56K. In other words, setting the temperature of the image recording drum 52 to be lower than that of the inkjet heads 56C, 56M, 56Y, and 56K can induce the dew condensation on the image recording drum side and can prevent the dew condensation from occurring on the inkjet heads 56C, 56M, 56Y, and 56K (particularly, dew condensation occurring on the nozzle face).

The image recording unit 18 is configured as described above. The paper sheet P passed from the treatment liquid drying treatment drum 46 in the treatment liquid drying treatment unit 16 is received by the image recording drum 52. The image recording drum 52 rotates with gripping the leading end of the paper sheet P by the gripper 52A to transport the paper sheet P. The paper sheet P passed to the image recording drum 52 firstly passes through the paper pressing roller 54 to be brought into tight contact with the peripheral surface of the image recording drum 52. At the same time as this, the paper sheet P is sucked from the suction apertures of the image recording drum 52 to be held by suction on the outer peripheral surface of the image recording drum 52. The paper sheet P is transported in this state while passing through each of the inkjet heads 56C, 56M, 56Y, and 56K. Then, in passing through the inkjet heads, the surface of the paper sheet P undergoes deposition of the liquid droplets of ink each of colors C, M, Y, and K from each of the inkjet heads 56C, 56M, 56Y, and 56K, respectively to render a color image on the relevant surface. The ink aggregation layer formed on the surface of the paper sheet P allows an image of high quality to be recorded without occurring feathering, bleeding and the like.

The paper sheet P having the image recorded thereon by the inkjet heads 56C, 56M, 56Y, and 56K is next to pass through the inline sensor 58. In passing through the inline sensor 58, the image recorded on the surface is read out. This reading out of the recorded image is carried out as needed such that the read out image is checked for deposition failure and the like. In carrying out of the reading out, the reading out is carried out in a state of being held by the image recording drum 52 by suction, allowing highly accurate reading out. Additionally, since the reading out is carried out immediately after recording the image, abnormity such as the deposition failure and the like can be immediately detected, for example, a measure against which can be rapidly taken. This can prevent recording in vain and can minimize occurrence of waste sheets.

After that, the paper sheet P is released from the suction, and thereafter, is passed to the ink drying treatment unit 20.

<Ink Drying Treatment Unit>

The ink drying treatment unit 20 subjects the paper sheet P after image recording to the drying treatment to remove liquid components remained on the surface of the paper sheet P. The ink drying treatment unit 20 is configured to include a chain gripper 64 for transporting the paper sheet P having the image recorded thereon, a back tension giving mechanism 66 for giving a back tension to the paper sheet P being transported by the chain gripper 64, an ink drying treatment unit 68 for subjecting the paper sheet P being transported by the chain gripper 64 to the drying treatment.

The chain gripper 64, which is a paper transporting mechanism used in common by the ink drying treatment unit 20, the UV irradiating treatment unit 22, and the paper discharge unit 24, receives the paper sheet P passed from the image recording unit 18 to transport to the paper discharge unit 24.

The chain gripper 64 includes a first sprocket 64A arranged in the vicinity of the image recording drum 52, a second sprocket 64B arranged in the paper discharge unit 24, a chain 64C, with no ends, wound around across the first sprocket 64A and the second sprocket 64B, a plurality of chain guides (not illustrated) for guiding run of the chain 64C, and a plurality of grippers 64D attached to the chain 64C at certain intervals. The first sprockets 64A, the second sprockets 64B, the chains 64C, and the chain guides are respectively formed into a pair to be arranged on both ends in the width direction of the paper sheet P. Each gripper 64D is arranged to be put across the chains 64C provided in a pair.

The first sprocket 64A is arranged in the vicinity of the image recording drum 52 such that the paper sheet P passed from the image recording drum 52 is received by the gripper 64D. The first sprocket 64A is rotatably arranged by being journaled by a bearing (not illustrated) and is connected with a motor (not illustrated). The chain 64C wound around across the first sprocket 64A and the second sprocket 64B runs by driving this motor.

The second sprocket 64B is arranged in the paper discharge unit 24 such that the paper sheet P received from the image recording drum 52 is collected in the paper discharge unit 24. In other words, the arrangement position of the second sprocket 64B is a terminal of the transporting path of the paper sheet P relating to the chain gripper 64. The second sprocket 64B is rotatably arranged by being journaled by the bearing (not illustrated).

The chain 64C is formed to have no ends and wound around across the first sprocket 64A and the second sprocket 64B.

The chain guides are arranged at predetermined positions to guide such that the chain 64C runs a predetermined course (i.e., to guide such that the paper sheet P is transported while running a predetermined transporting path). In the inkjet recording device 10 in this example, the second sprocket 64B is arranged at a position higher than the first sprocket 64A. This forms a running course in which the chain 64C becomes inclined in an intermediate portion. Specifically, the chain 64C includes a first horizontal transporting path 70A, an inclined transporting path 70B, and a second horizontal transporting path 70C.

The first horizontal transporting path 70A is set to be at the same height as the first sprocket 64A to set such that chain 64C wound across the first sprocket 64A horizontally runs.

The second horizontal transporting path 70C is set to be at the same height as the second sprocket 64B to set such that the chain 64C wound across the second sprocket 64B horizontally runs.

The inclined transporting path 70B is set between the first horizontal transporting path 70A and the second horizontal transporting path 70C to set so as to link between the first horizontal transporting path 70A and the second horizontal transporting path 70C.

The chain guides are arranged to form the first horizontal transporting path 70A, the inclined transporting path 70B, and the second horizontal transporting path 70C. Specifically, the chain guides are arranged at least at a joining point between the first horizontal transporting path 70A and the inclined transporting path 70B and at a joining point between the inclined transporting path 70B and the second horizontal transporting path 70C.

The plurality of grippers 64D are attached to the chain 64C at certain intervals. The attachment interval for the gripper 64D is set corresponding to a reception interval at which the paper sheet P is received from the image recording drum 52. In other words, the attachment interval is set to correspond to the reception interval of the paper sheet P from the image recording drum 52 such that the paper sheet P sequentially passed from the image recording drum 52 can be received from the image recording drum 52 at a timing of the paper sheet being passed.

The chain gripper 64 is configured as described above. As described above, when the motor (not illustrated) connected to the first sprocket 64A is driven, the chain 64C runs. The chain 64C runs at the same speed as the circumferential speed of the image recording drum 52. The timing is adjusted such that the paper sheet P passed from the image recording drum 52 can be received by each gripper 64D.

The back tension giving mechanism 66 gives back tension to the paper sheet P which is transported while the leading end being gripped by the chain gripper 64. The back tension giving mechanism 66 mainly includes a guide plate 72 and a sucking mechanism (not illustrated) for sucking an air from sucking holes (not illustrated) formed on the guide plate 72.

The guide plate 72 includes a hollow box plate having a width corresponding to the paper width. The guide plate 72 is arranged along the transporting path of the paper sheet P relating to the chain gripper 64 (i.e., running course of the chain). Specifically, the guide plate 72 is arranged along the chain 64C running the first horizontal transporting path 70A and the inclined transporting path 70B, and arranged to be separated from the chain 64C by a predetermined distance. The paper sheet P being transported by the chain gripper 64 is transported with a back surface thereof (surface having no image recorded thereon) being slidably in contact with on a top surface of the guide plate 72 (surface facing the chain 64C: slidable contact surface).

The slidable contact surface (top surface) of the guide plate 72 has plenty of sucking holes formed (not illustrated) in a predetermined pattern. As described above, the guide plate 72 is formed of the hollow box plate. The sucking mechanism (not illustrated) sucks a hollow portion (inside) of the guide plate 72. This allows the air to be sucked from the sucking holes formed on the slidable contact surface.

Sucking the air from the sucking holes of the guide plate 72 causes the back surface of the paper sheet P being transported by the chain gripper 64 to be sucked to the sucking holes. This gives the back tension to the paper sheet P being transported by the chain gripper 64.

As described above, since the guide plate 72 is arranged along the chain 64C running the first horizontal transporting path 70A and the inclined transporting path 70B, the paper sheet P is given the back tension while being transported on the first horizontal transporting path 70A and the inclined transporting path 70B.

The ink drying treatment unit 68 is arranged inside the chain gripper 64 (particularly, a portion constituting first horizontal transporting path 70A) to subject the paper sheet P being transported on the first horizontal transporting path 70A to the drying treatment. The ink drying treatment unit 68 blows a hot air to the surface of the paper sheet P being transported on the first horizontal transporting path 70A to be subjected to the drying treatment. A plurality of ink drying treatment units 68 are arranged along the first horizontal transporting path 70A. The number of the ink drying treatment units 68 arranged is set depending on a capacity of the ink drying treatment unit 68, a transporting speed of the paper sheet P (equal to the printing speed) or the like. In other words, the number is set such that the paper sheet P received from the image recording unit 18 can be dried while being transported on the first horizontal transporting path 70A. Therefore, a length of the first horizontal transporting path 70A is also set in consideration of the capacity of the ink drying treatment unit 68.

Note that the drying treatment causes a humidity of the ink drying treatment unit 20 to be risen. Since rising of the humidity makes the efficient drying treatment difficult, it is preferable that the ink drying treatment unit 20 is provided with exhaust means together with the ink drying treatment unit 68 to forcibly exhaust humid air generated due to the drying treatment. The exhaust means may have a configuration in which, for example, an exhaust duct is arranged at the ink drying treatment unit 20 to exhaust the air in the ink drying treatment unit 20 by the exhaust duct.

The ink drying treatment unit 20 is configured as described above. The paper sheet P passed from the image recording drum 52 in the image recording unit 18 is received by the chain gripper 64. The chain gripper 64 transports the paper sheet P along the planar guide plate 72 with gripping the leading end of the paper sheet P by the gripper 64D. The paper sheet P passed to the chain gripper 64 is firstly transported on the first horizontal transporting path 70A. In the course of being transported on the first horizontal transporting path 70A, the paper sheet P is subjected to the drying treatment by the ink drying treatment unit 68 arranged inside the chain gripper 64. In other words, the hot air is blown to the surface (image record surface) to be subjected to the drying treatment. At this time, the paper sheet P is given the back tension by the back tension giving mechanism 66 while being subjected to the drying treatment. By doing so, the paper sheet P can be prevented from being deformed while being subjected to the drying treatment.

<UV Irradiating Treatment Unit>

The UV irradiating treatment unit 22 irradiates the image recorded by use of the aqueous UV ink with ultraviolet (UV) rays to fix the image. The UV irradiating treatment unit 22 includes the chain gripper 64 for transporting the paper sheet P subjected to the drying treatment, the back tension giving mechanism 66 for giving the back tension to the paper sheet P being transported by the chain gripper 64, and a UV irradiation unit 74 for irradiating the paper sheet P being transported by the chain gripper 64 with the ultraviolet rays.

As described above, the chain gripper 64 and the back tension giving mechanism 66 are used together in common by the ink drying treatment unit 20 and the paper discharge unit 24.

The UV irradiation unit 74 is arranged inside the chain gripper 64 (particularly, a portion constituting the inclined transporting path 70B) to irradiate with the ultraviolet rays the surface of the paper sheet P being transported on the inclined transporting path 70B. A plurality of UV irradiation units 74, each including the ultraviolet rays lamp (UV lamp), are arranged along the inclined transporting path 70B. Then, the ultraviolet irradiation units 74 irradiate the ultraviolet rays toward the surface of the paper sheet P being transported on the inclined transporting path 70B. The arranged number of the UV irradiation unit 74 is set depending on the transporting speed of the paper sheet P (equal to the printing speed) or the like. In other words, the configuration is such that the image can be fixed by the ultraviolet rays irradiated while the paper sheet P is transported on the inclined transporting path 70B. Therefore, a length of the inclined transporting path 70B is also set in consideration of the transporting speed of the paper sheet P or the like.

The UV irradiating treatment unit 22 is configured as described above. The paper sheet P transported by the chain gripper 64 to be subjected to the drying treatment by the ink drying treatment unit 20 is next transported on the inclined transporting path 70B. In the course of being transported on the inclined transporting path 70B, the paper sheet P is subjected to the UV irradiation treatment by the UV irradiation unit 74 arranged inside the chain gripper 64. In other words, the ultraviolet rays are irradiated from the UV irradiation unit 74 toward the surface. At this time, the paper sheet P is given the back tension by the back tension giving mechanism 66 while being subjected to the UV irradiation treatment. By doing so, the paper sheet P can be prevented from being deformed while being subjected to the UV irradiation treatment. Since the UV irradiating treatment unit 22 is arranged on the inclined transporting path 70B and the inclined transporting path 70B is provided with the inclined guide plate 72, even if the paper sheet P falls off the gripper 64D in the middle of transportation, the paper sheet can be slid on the guide plate 72 to be taken out.

<Paper Discharge Unit>

The paper discharge unit 24 collects the paper sheet P having been subjected to a series of image recording processes. The paper discharge unit 24 is configured to mainly include the chain gripper 64 for transporting the paper sheet P having undergone UV irradiation, and a paper discharge platform 76 collecting the paper sheet P to be stacked thereon.

As described above, the chain gripper 64 is used together in common by the ink drying treatment unit 20 and the UV irradiating treatment unit 22. The chain gripper 64 releases the paper sheet P on the paper discharge platform 76 to stack the paper sheet P on the paper discharge platform 76.

The paper discharge platform 76 collects the paper sheet P released by the chain gripper 64 to be stacked thereon. The paper discharge platform 76 is provided with paper stops (front paper stop, rear paper stop, side paper stop or the like) (not illustrated) so as to neatly stack the paper sheet P.

The paper discharge platform 76 is provided so as to be capable of being lifted and lowered by a paper discharge platform lifting and lowering device (not illustrated). The paper discharge platform lifting and lowering device is controlled to be driven in conjunction with increase and decrease of the paper sheets P stacked on the paper discharge platform 76 to lift and lower the paper discharge platform 76 such that the paper sheet P placed on the top is always is positioned at a certain height.

<Configuration of Paper Sheet Transporting Device>

In the inkjet recording device 10 configured as described above, the transporting path including at least the treatment liquid deposition drum 42, the treatment liquid drying treatment drum 46, and the image recording drum 52 corresponds to the paper sheet transporting device.

Figure 18:
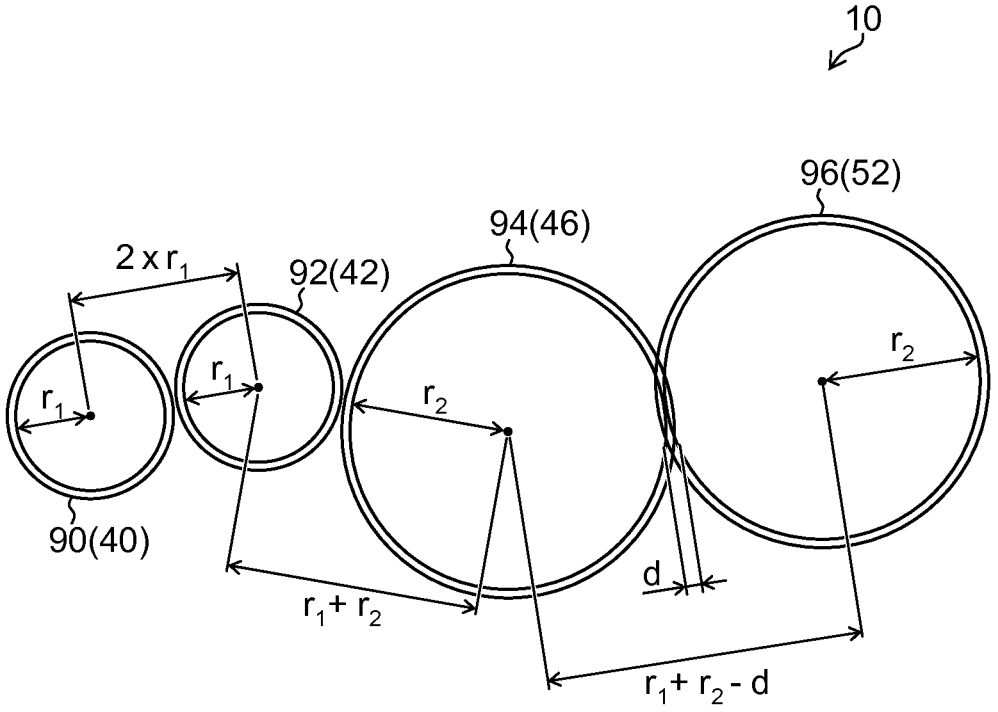
FIG. 18 is a configuration diagram of a rotary drive mechanism of the inkjet recording device according to the embodiment.

FIG. 18 is a configuration diagram illustrating a lateral side opposite to that illustrated in FIG. 17, and illustrates the rotary drive mechanism for the paper feed drum 40, treatment liquid deposition drum 42, treatment liquid drying treatment drum 46, and image recording drum 52 (an example of the plural transporting barrels). As illustrated in the figure, the inkjet recording device 10 includes a toothed wheel (gear) 90 directly coupled in a concentric manner with a rotation shaft of the paper feed drum 40, a toothed wheel 92 directly coupled in a concentric manner with a rotation shaft of the treatment liquid deposition drum 42, a toothed wheel 94 directly coupled in a concentric manner with a rotation shaft of the treatment liquid drying treatment drum 46, and a toothed wheel 96 directly coupled in a concentric manner with a rotation shaft of the image recording drum 52.

The respective toothed wheels 90 to 96 are formed to have the same diameters as the paper feed drum 40, the treatment liquid deposition drum 42, the treatment liquid drying treatment drum 46, and the image recording drum 52, respectively, to which the respective toothed wheels are directly coupled. In this example, radiuses of the paper feed drum 40 and the treatment liquid deposition drum 42 are $r_1$, and radiuses of the treatment liquid drying treatment drum 46 and the image recording drum 52 are $r_2$. $r_1$ and $r_2$ have a relationship of $r_2=2\times r_1$ (an example of integral multiple relationship with each other).

The toothed wheel 90 and the toothed wheel 92 engage with each other. The toothed wheel 92 and the toothed wheel 94 engage with other, and the toothed wheel 94 and the toothed wheel 96 engage with each other. The inter-shaft distance between the paper feed drum 40 and the treatment liquid deposition drum 42 is set to be $2\times r_1$, and the inter-shaft distance between the treatment liquid deposition drum 42 and the treatment liquid drying treatment drum 46 is set to be $r_1+r_2$. The inter-shaft distance between the treatment liquid drying treatment drum 46 and the image recording drum 52 is set to be $r_1+r_2-d$ with the drive ratio being maintained by shifting the toothed wheel 96.

The inkjet recording device 10 has a motor for rotation (not illustrated) provided thereto as a motive power source for the paper sheet transporting system. The motive power from the motor for rotation is transmitted to the toothed wheels 90, 92, 94, and 96 in this order, and these toothed wheels 90, 92, 94, and 96 work in conjunction with each other to rotate the paper feed drum 40, the treatment liquid deposition drum 42, the treatment liquid drying treatment drum 46, and the image recording drum 52. In the case of this example, when the paper feed drum 40 rotates two revolutions, the treatment liquid deposition drum 42 rotates two revolution, and the treatment liquid drying treatment drum 46 and the image recording drum 52 rotate one revolution.

In the paper sheet transporting path configured in this way, the gripper 40A of the paper feed drum 40, the gripper 42A of the treatment liquid deposition drum 42, and the gripper 46A of the treatment liquid drying treatment drum 46 are each arranged on outer peripheral surface thereof, and thus, the trajectory of the leading end portion of the paper sheet P is continuous, and the passing of the paper sheet P via the grippers is carried out with no paper sheet deformation being generated.

The gripper 52A of the image recording drum 52 is arranged inwardly by the distance d from the outer peripheral surface of the image recording drum 52, but the inter-shaft distance between the treatment liquid drying treatment drum 46 and the image recording drum 52 is set to be $r_1+r_2-d$, and thus, the gripper 46A of the treatment liquid drying treatment drum 46 and the gripper 52A of the image recording drum 52 align on the same line at a position where the paper sheet P is passed. Therefore, the trajectory of the leading end portion of the paper sheet P is continuous, and the passing of the paper sheet P via the grippers is carried out with no paper sheet deformation being generated.

In this way, according to the inkjet recording device 10, the arrangement of the grippers of the image recording drum sunk down inwardly of the image recording drum enables the high-definition inkjet printing. Moreover, the paper sheet distortion can be suppressed to be small and a degree of contact of the paper sheet with the image recording drum can be increased, which enables the high-definition inkjet printing. Further, the inter-shaft distance between the image recording drum and the drum at the prior stage of image recording drum is set to be shorter by an amount involved by arranging the grippers of the image recording drum inwardly from the outer peripheral surface with the drive ratio being maintained by shifting the toothed wheel of the image recording drum, and other inter-shaft distances between the drums than those described above are set to be a sum of the radiuses of these drums, which makes it possible to arrange the grippers of the drums other than the image recording drum on the outer peripheral surfaces of the respective drums, allowing the stable transportation.

The technical scope of the present invention is not limited to a scope described in the above embodiments. The configuration or the like in the embodiments may be appropriately combined between the respective embodiments without departing from the gist of the present invention.

What is claimed is:

1. A recording medium transporting device comprising:

a printing barrel that rotates and transports with gripping an end portion of a recording medium inwardly from an outer peripheral surface thereof, an inkjet head configured to eject and deposit ink onto the recording medium being arranged on the outer peripheral surface so as to face the printing barrel;

a first transporting barrel that rotates and transports with gripping the end portion of the recording medium on an outer peripheral surface thereof for passing to the printing barrel and a second transporting barrel that rotates and transports with gripping the end portion of the recording medium on an outer peripheral surface thereof for passing to the first transporting barrel, wherein an inter-shaft distance between the printing barrel and the first transporting barrel is set to be a distance shorter by a distance d than a sum of a radius of the printing barrel and a radius of the first transporting barrel, and an inter-shaft distance between the first transporting barrel and the second transporting barrel is set to be a sum of the radius of the first transporting barrel and a radius of second transporting barrel, wherein the printing barrel grips the end portion of the recording medium inwardly by the distance d from the outer peripheral surface, wherein each of the printing barrel, the first transporting barrel, and the second transporting barrel has a gear coupled to a rotation shaft thereof, and the gear of the printing barrel and the gear of the first transporting barrel directly engage with each other, and the gears of the first transporting barrel and the second transporting barrel directly engage with each other, and the inter-shaft distance is set by shifting the gear of the printing barrel.

2. The recording medium transporting device according to claim 1, further comprising a motor configured to drive the gear of the printing barrel, the gear of the first transporting barrel and the gear of the second transporting barrel.

3. The recording medium transporting device according to claim 1, wherein each of diameters of the printing barrel, the first transporting barrel, and the second transporting barrel have an integral multiple relationship with each other.

4. The recording medium transporting device according to claim 3, wherein the printing barrel, the first transporting barrel, and the second transporting barrel have a same diameter.

5. The recording medium transporting device according to claim 1, wherein the printing barrel and the first transporting barrel have plural grasping units configured to grip by grasping the end portion of the recording medium along rotation shaft directions respectively, and the plural grasping units of the printing barrel and the plural grasping units of the first transporting barrel are alternately arranged along the rotation shaft directions respectively.

6. The recording medium transporting device according to claim 5, wherein when the recording medium is passed from the first transporting barrel to the printing barrel, the plural grasping units of the first transporting barrel and the plural grasping units of the printing barrel simultaneously grasp the end portion of the recording medium.

7. The recording medium transporting device according to claim 5, wherein the plural grasping units of the printing barrel are arranged on the outer peripheral surface at two locations that are symmetric positions about the rotation shaft of the printing barrel.

8. The recording medium transporting device according to claim 1, wherein the end portion of the recording medium is a leading end portion.

9. An inkjet recording device comprising:

the recording medium transporting device according to claim 1; and an inkjet head arranged so as to face the outer peripheral surface of the printing barrel.

10. A recording medium transporting device comprising:

a printing barrel that rotates and transports with gripping an end portion of a recording medium inwardly from an outer peripheral surface thereof, an inkjet head configured to eject and deposit ink onto the recording medium being arranged on the outer peripheral surface so as to face the printing barrel;

a first transporting barrel that rotates and transports with gripping the end portion of the recording medium received from the printing barrel on an outer peripheral surface thereof; and a second transporting barrel that rotates and transports with gripping the end portion of the recording medium received from the first transporting barrel on an outer peripheral surface thereof, wherein an inter-shaft distance between the printing barrel and the first transporting barrel is set to be a distance shorter by a distance d than a sum of a radius of the printing barrel and a radius of the first transporting barrel, and an inter-shaft distance between the first transporting barrel and the second transporting barrel is set to be a sum of the radius of the first transporting barrel and a radius of second transporting barrel, wherein the printing barrel grips the end portion of the recording medium inwardly by the distance d from the outer peripheral surface, wherein each of the printing barrel, the first transporting barrel, and the second transporting barrel has a gear coupled to a rotation shaft thereof, and the gear of the printing barrel and the gear of the first transporting barrel directly engage with each other, and the gears of the first transporting barrel and the second transporting barrel directly engage with each other, and the inter-shaft distance is set by shifting the gear of the printing barrel.

11. The recording medium transporting device according to claim 10, further comprising a motor configured to drive the gear of the printing barrel, the gear of the first transporting barrel and the gear of the second transporting barrel.

12. The recording medium transporting device according to claim 10, wherein each of diameters of the printing barrel, the first transporting barrel, and the second transporting barrel have an integral multiple relationship with each other.

13. The recording medium transporting device according to claim 12, wherein the printing barrel, the first transporting barrel, and the second transporting barrel have a same diameter.

14. The recording medium transporting device according to claim 10, wherein the printing barrel and the first transporting barrel have plural grasping units configured to grip by grasping the end portion of the recording medium along rotation shaft directions respectively, and the plural grasping units of the printing barrel and the plural grasping units of the first transporting barrel are alternately arranged along the rotation shaft directions respectively.

15. The recording medium transporting device according to claim 14, wherein when the recording medium is passed from the printing barrel to the first transporting barrel, the plural grasping units of the first transporting barrel and the plural grasping units of the printing barrel simultaneously grasp the end portion of the recording medium.

16. The recording medium transporting device according to claim 14, wherein the plural grasping units of the printing barrel are arranged on the outer peripheral surface at two locations that are symmetric positions about the rotation shaft of the printing barrel.

17. The recording medium transporting device according to claim 10, wherein the end portion of the recording medium is a leading end portion.

18. An inkjet recording device comprising:

the recording medium transporting device according to claim 10; and an inkjet head arranged so as to face the outer peripheral surface of the printing barrel.

* * * * *